US010759175B2

(12) United States Patent
Masuda et al.

(10) Patent No.: US 10,759,175 B2
(45) Date of Patent: Sep. 1, 2020

(54) LIQUID DISCHARGE HEAD, HEAD MODULE, LIQUID DISCHARGE DEVICE, AND LIQUID DISCHARGE APPARATUS

(71) Applicants: Toshiaki Masuda, Kanagawa (JP); Tsutoh Aoyama, Kanagawa (JP); Takahiko Kuroda, Kanagawa (JP); Masaki Kato, Tokyo (JP)

(72) Inventors: Toshiaki Masuda, Kanagawa (JP); Tsutoh Aoyama, Kanagawa (JP); Takahiko Kuroda, Kanagawa (JP); Masaki Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/278,937

(22) Filed: Feb. 19, 2019

(65) Prior Publication Data

US 2019/0270310 A1 Sep. 5, 2019

(30) Foreign Application Priority Data

Mar. 2, 2018 (JP) ..... 2018-037327
Dec. 27, 2018 (JP) ..... 2018-245490

(51) Int. Cl.
*B41J 2/175* (2006.01)
*B41J 2/145* (2006.01)
(Continued)

(52) U.S. Cl.
CPC ..... *B41J 2/175* (2013.01); *B41J 2/145* (2013.01); *B41J 2/14233* (2013.01); *B41J 2/161* (2013.01);
(Continued)

(58) Field of Classification Search
CPC ..... B41J 2/175; B41J 2/1632; B41J 2/1629; B41J 2/1631; B41J 2/161; B41J 2/14233;
(Continued)

(56) References Cited

U.S. PATENT DOCUMENTS

2002/0175976 A1* 11/2002 Okuda ..... B41J 2/161 347/71
2006/0007272 A1 1/2006 Ogata et al.
(Continued)

FOREIGN PATENT DOCUMENTS

JP 2002-144582 5/2002
JP 2002-264329 9/2002
(Continued)

*Primary Examiner* — Huan H Tran
*Assistant Examiner* — Alexander D Shenderov
(74) *Attorney, Agent, or Firm* — Harness, Dickey & Pierce, P.L.C.

(57) ABSTRACT

A liquid discharge head includes a plurality of nozzles to discharge a liquid, a plurality of pressure chambers communicating with the plurality of nozzles, respectively, a plurality of individual supply channels communicating with the plurality of pressure chambers, respectively, a plurality of common-supply branch channels each having a side face and a bottom face and communicating with two or more of the plurality of individual supply channels, respectively, and a common-supply main channel communicating with the plurality of common-supply branch channels. The plurality of common-supply branch channels includes a curved portion on a corner between the side face and the bottom face of each of the plurality of common-supply branch channels along a direction of liquid flow in the plurality of common-supply branch channels.

15 Claims, 16 Drawing Sheets

(51) Int. Cl.
*B41J 2/16* (2006.01)
*B41J 2/14* (2006.01)

(52) U.S. Cl.
CPC ..... *B41J 2/1623* (2013.01); *B41J 2/1628* (2013.01); *B41J 2/1629* (2013.01); *B41J 2/1631* (2013.01); *B41J 2/1632* (2013.01); *B41J 2/1642* (2013.01); *B41J 2002/14362* (2013.01); *B41J 2002/14491* (2013.01); *B41J 2202/20* (2013.01)

(58) Field of Classification Search
CPC ..... B41J 2/1623; B41J 2/1628; B41J 2/1642; B41J 2/145; B41J 2002/14362; B41J 2202/20; B41J 2002/14491
USPC ..... 347/85
See application file for complete search history.

(56) References Cited

U.S. PATENT DOCUMENTS

| | | | | |
|---|---|---|---|---|
| 2008/0062226 | A1 | 3/2008 | Urasaki | |
| 2010/0020130 | A1* | 1/2010 | Hashimoto | B41J 2/1606 347/47 |
| 2011/0057992 | A1 | 3/2011 | Tobita et al. | |
| 2012/0206545 | A1 | 8/2012 | Kato et al. | |
| 2013/0070018 | A1 | 3/2013 | Sasaki | |
| 2014/0036007 | A1 | 2/2014 | Sasaki | |
| 2016/0001556 | A1 | 1/2016 | Masuda et al. | |
| 2017/0100934 | A1 | 4/2017 | Masuda et al. | |

FOREIGN PATENT DOCUMENTS

| | | |
|---|---|---|
| JP | 2002-307676 | 10/2002 |
| JP | 2003-072065 | 3/2003 |
| JP | 2004-299345 | 10/2004 |
| JP | 2006-082394 | 3/2006 |
| JP | 2008-087464 | 4/2008 |
| JP | 2009-226942 | 10/2009 |
| JP | 2011-056692 | 3/2011 |
| JP | 2013-063532 | 4/2013 |
| JP | 2013-193213 | 9/2013 |
| JP | 2014-030939 | 2/2014 |
| JP | 2014-166755 | 9/2014 |
| JP | 2015-030153 | 2/2015 |
| JP | 2015-036238 | 2/2015 |
| JP | 2015-104911 | 6/2015 |
| JP | 2016-168804 | 9/2016 |
| JP | 2016-179555 | 10/2016 |
| JP | 2017-001232 | 1/2017 |

* cited by examiner

LIQUID DISCHARGE HEAD, HEAD MODULE, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-037327, filed on Mar. 2, 2018, and Japanese Patent Application No. 2018-245490, filed on Dec. 27, 2018, in the Japan Patent Office, the entire disclosure of each of which is hereby incorporated by reference herein.

BACKGROUND

Technical Field

Aspects of the present disclosure relate to a liquid discharge head, a head module, a liquid cartridge, a liquid discharge device, and a liquid discharge apparatus.

Related Art

As an image forming apparatus to form image on a recording medium such as a sheet of paper, an inkjet recording apparatus is known that includes an inkjet head mounted on a carriage. The inkjet recording apparatus discharges ink droplets from the inkjet head onto the recording medium while reciprocally moving the carriage in a main scanning direction to form a desired image pattern on the recording medium.

An inkjet head in such an inkjet recording apparatus includes a plurality of pressure chambers and nozzles, a common chamber, a piezoelectric device including a piezoelectric element and a heater, and a drive integrated circuit (IC) to drive the inkjet head. The piezoelectric device is disposed adjacent to the pressure chamber.

When ink is supplied from the ink tank to the common chamber, some air in the common chamber may remain in the common chamber as air bubbles. When the air bubbles remained in the common chamber, the air bubbles may be guided to the nozzles when the inkjet head discharges ink droplets from the nozzles. Thus, discharge failure of the ink droplets may occur that causes defects in image quality.

SUMMARY

In an aspect of this disclosure, an improved liquid discharge head includes a plurality of nozzles to discharge a liquid, a plurality of pressure chambers communicating with the plurality of nozzles, respectively, a plurality of individual supply channels communicating with the plurality of pressure chambers, respectively, a plurality of common-supply branch channels each having a side face and a bottom face and communicating with two or more of the plurality of individual supply channels, respectively, and a common-supply main channel communicating with the plurality of common-supply branch channels. The plurality of common-supply branch channels includes a curved portion on a corner between the side face and the bottom face of each of the plurality of common-supply branch channels along a direction of liquid flow in the plurality of common-supply branch channels.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
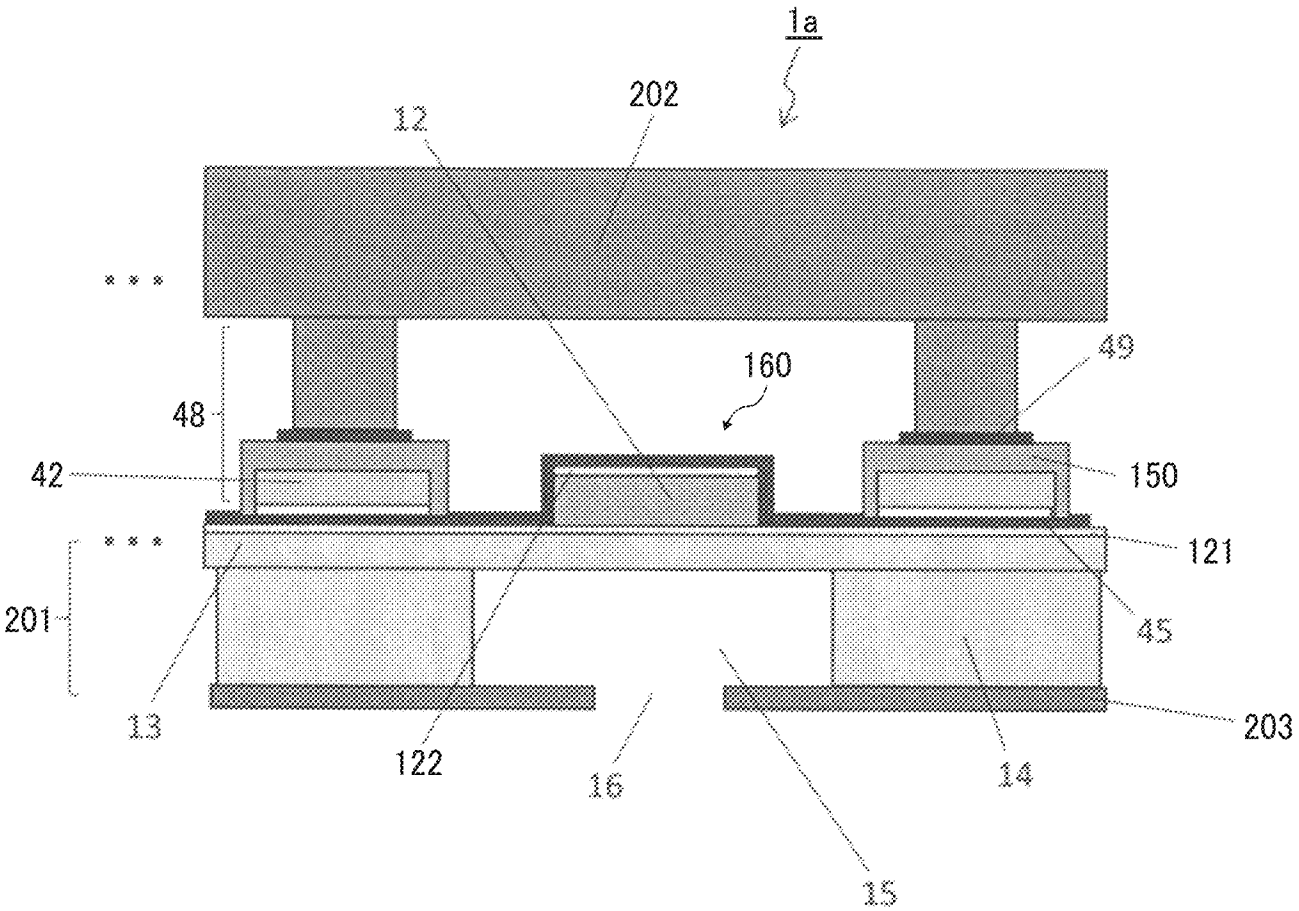
FIG. 1 is a cross-sectional view of an example of a liquid discharge head according to embodiments of the present disclosure in a transverse direction of a liquid chamber.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

FIG. 1 is a cross-sectional view of an example of a liquid discharge head according to the present disclosure in a transverse direction of a pressure chamber.

Figure 2:
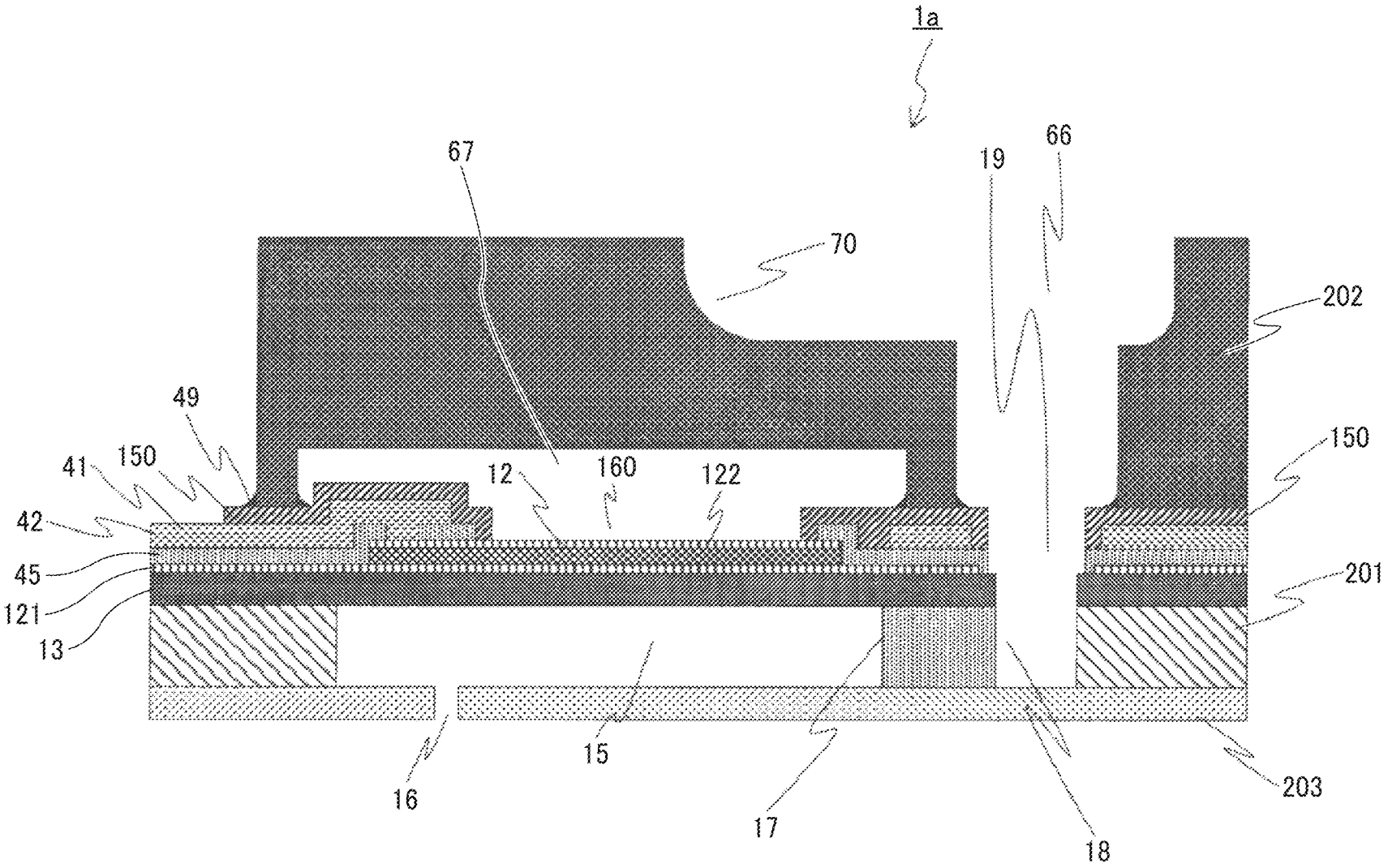
FIG. 2 is a cross-sectional view of the example of the liquid discharge head according to embodiments in a longitudinal direction of the liquid chamber.

FIG. 2 is a cross-sectional view of an example of the liquid discharge head according to the present disclosure in a longitudinal direction of the pressure chamber.

Figure 3:
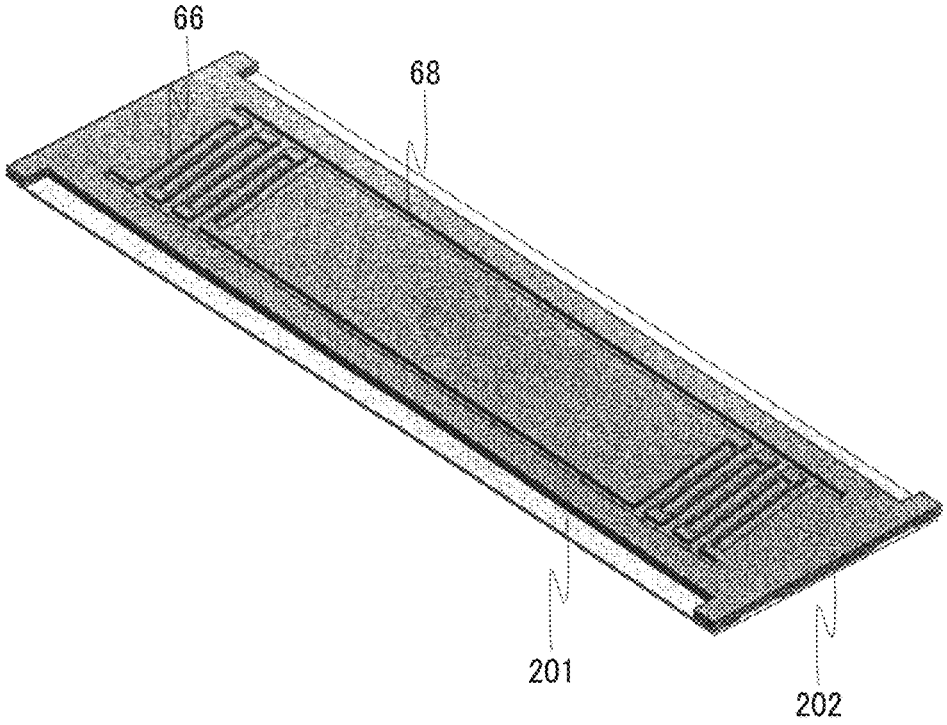
FIG. 3 is a perspective view of the example of a support substrate of the liquid discharge head according to embodiments.

FIG. 3 is an external perspective view of an example of a support substrate of the liquid discharge head.

The liquid discharge head 1*a* includes a piezoelectric device 12 to generate energy to discharge the liquid and a diaphragm 13 on an actuator substrate 201 in which a pressure-chamber partition wall 14 and a pressure chamber 15 are formed.

Hereinafter, "the liquid discharge head" is simply referred to as "head". The pressure chamber 15 is partitioned by the pressure-chamber partition wall 14.

The piezoelectric device 12 is sandwiched between a common electrode 121 and an individual electrode 122, and a wiring layer is laminated on each electrode layers to apply voltage on the piezoelectric device 12. A pressure chamber 15 is formed by the actuator substrate 201 and a nozzle substrate 203. The actuator substrate 201, and the support substrate 202 and the nozzle substrate 203 are bonded to form the head 1*a*. Silicon is used as a base material of the actuator substrate 201 and the support substrate 202. The actuator substrate 201 includes a common chamber 18 and a branch chamber 66. The actuator substrate 201 and the support substrate 202 made of silicon have sufficient rigidity. Further, it becomes easier to process the common chamber 18 and the branch chamber 66 in the actuator substrate 201 and the support substrate 202.

The head 1*a* configured as described above fills each pressure chambers 15 with a liquid, for example, a recording liquid (ink). The head 1*a* applies a pulse voltage of 20 V, for example, generated by an oscillation circuit, to the piezoelectric device 12 via an individual electrode 122 corresponding to the nozzle 16 from which the liquid is to be discharged, through a lead wire 42 and a connection hole formed in an interlayer insulating film 45 based on image data sent from a controller when each of the pressure chambers 15 is filled with the liquid.

Application of the pulse voltage makes the piezoelectric device 12 contract in a direction parallel to the diaphragm 13 due to an electrostrictive effect, and the diaphragm 13 bends toward the pressure chamber 15. Thus, the pressure in the pressure chamber 15 rises sharply, and the recording liquid is discharged from the nozzle 16 communicating with the pressure chamber 15.

After the application of the pulse voltage, the shrunk piezoelectric device 12 returns to an original position, and the bent (deflected) diaphragm 13 returns to an original position. Thus, a pressure inside the pressure chamber 15 becomes negative compared to the common chamber 18 (see FIG. 2), and the liquid (ink) supplied from the outside via the branch chamber 66 is supplied to the pressure chamber 15 via a fluid restrictor 17 from a common-supply channel 19 and the common chamber 18. Repeating the above-described processes, the head 1*a* can continuously discharge the liquid and form an image on a recording medium (sheet) arranged opposite to the head 1*a*.

A method of manufacturing the head 1*a* according to the present disclosure is described below. The head 1*a* is manufactured according to the following processes (1) to (10).

(1) The diaphragm 13 is film-formed on a silicon single-crystal substrate having a plane orientation (100) as the actuator substrate 201. For example, the silicon single crystal substrate having a plate thickness of 400 μm may be used as the actuator substrate 201. The diaphragm 13 may be a single layer or a laminated film as long as the diaphragm 13 has a function as a diaphragm and is consistent with the subsequent manufacturing process.

For example, as a material of the diaphragm 13, a silicon oxide film, a polysilicon film, an amorphous silicon film, or a silicon nitride film is used. The silicon oxide film, the polysilicon film, the amorphous silicon film, or the silicon nitride film is laminated to be film-formed by a Low-Pressure Chemical Vapor Deposition (LP-CVD) method to obtain desired rigidity.

Considering the consistency of manufacturing process, the rigidity of the diaphragm 13, and the stress applied on the diaphragm 13 as a whole, number of layers of lamination is preferably about three to seven layers. The uppermost layer of the diaphragm 13 is a silicon oxide film formed by the LP-CVD method to ensure adhesion with the common electrode 121 formed after the diaphragm 13. Then, a layer of the common electrode 121 made of $TiO_2$ and Pt is film-formed by a sputtering method to have thicknesses of 10 nm and 160 nm, respectively.

(2) Next, a film made of lead zirconate titanate (PZT) is film-formed for a plurality of times on the common electrode 121 as the piezoelectric device 12 by a spin coat method, for example, and the film is deposited until the film has a thickness of 2 μm. Next, the individual electrodes 122 made of strontium oxide (SRO) and Pt are film-formed by the sputtering method to have thicknesses of 40 nm and 100 nm, respectively.

The method of forming the piezoelectric device 12 is not limited to the spin coating method. For example, a sputtering method, an ion plating method, an aerosol method, a sol-gel method, an inkjet method, or the like can be used. Then, the piezoelectric device 12 and the individual electrode 122 are formed by the photolithography-etching method at positions corresponding to the pressure chambers 15 to be formed later. Further, the piezoelectric device 12 is formed at a position corresponding to a bonding portion 48 (see FIG. 1).

(3) Next, an interlayer insulating film 45 is formed in order to insulate the common electrode 121 and the piezoelectric device 12 from the lead wire 42 to be formed later. Here, the interlayer insulating film 45 is formed by depositing an $SiO_2$ film to 1000 nm, for example, by a plasma Chemical Vapor Deposition (CVD) method. The interlayer insulating film 45 may be a film other than the $SiO_2$ film by the plasma CVD method as long as the film has an insulating property without affecting the piezoelectric device 12 and an electrode material.

Next, connection holes for connecting the individual electrode 122 and the lead wire 42 are formed by the photolithography-etching method. When the common electrode 121 is connected to the lead wire 42, a connection hole is similarly formed.

(4) Next, a film made of TiN/Al, for example, is film-formed to 30 nm and 3 μm, respectively, as a lead wire 42 by the sputtering method. The film made of TiN is used as a barrier layer to prevent alloying of Pt, which is a material of the individual electrode 122 or the common electrode 121 with Al, which is a material of the lead wire 42.

Alloyed Pt changes volume and generates stress to cause peeling of the film. Pt is alloyed when Pt is contact directly with Al at a bottom of the contact hole and is alloyed during a thermal history of a later manufacturing process. Further, the lead wire 42 is also formed in a portion to become the bonding portion 48 to be bonded with the support substrate 202 later.

(5) Next, as the passivation film 150, a silicon nitride film is formed to a thickness of 1000 nm, for example, by the plasma CVD method.

(6) Then, an opening is formed in the lead wire pad 41, an actuator 160, and the common-supply channel 19 of the lead wire 42 by the lithography-etching method.

(7) Next, the diaphragm 13 at a portion to be the common-supply channel 19 and the common chamber 18 is removed by the lithography-etching method.

(8) Next, a concave portion 67 is formed at a position corresponding to the actuator 160 by the lithography-etching method to form a main chamber 68 and a branch chamber 66. Further, a curved portion 70 is formed on a corner between a side wall (side face) and a bottom wall (bottom face) of the branch chamber 66 in the support substrate 202.

At this time, the support substrate 202 made of Si is processed by dry etching. Controlling conditions of the dry etching enables control of the degree of roundness (radius) of a curved portion 70 in a vicinity of a partition wall. Then, the support substrate 202 and the actuator substrate 201 are bonded together with the adhesive 49 via the bonding portion 48.

At this time, the adhesive 49 is coated to a thickness of about 1 μm on the support substrate 202 by a general thin-film transfer device. Then, the actuator substrate 201 is polished by a known technique to have a desired thickness (for example, a thickness of 80 μm) to form the pressure chamber 15, the common chamber 18, and the fluid restrictor 17. Alternatively, the actuator substrate 201 may be etched, for example, instead of polished.

(9) Next, the partition wall of the head 1*a* other than the partition walls of the pressure chamber 15, the common chamber 18, and the fluid restrictor 17 is covered with a resist by the lithography-etching method. Then, anisotropic wet etching is performed with an alkaline solution (potassium hydroxide (KOH) solution or Tetramethylammonium hydroxide (TMAH) solution) to form the pressure chamber 15, the common chamber 18, and the fluid restrictor 17. Further, the dry etching using an Inductively Coupled Plasma (ICP) etcher may be used to form the pressure chamber 15, the common chamber 18, and the fluid restrictor 17 other than the anisotropic wet etching using an alkaline solution.

(10) Next, the head 1*a* is manufactured by bonding the nozzle substrate 203 to the actuator substrate 201. The nozzle substrate 203 includes the nozzles 16 opened at positions corresponding to the pressure chambers 15 formed separately with the nozzles 16.

The head 1*a* manufactured through the above-described processes (1) to (10) including the curved portion 70 formed on the corner between the side face and the bottom face of the branch chamber 66 has enhanced bubble discharging property and can prevent discharge failure or decrease in the discharge speed. Thus, the above-described manufacturing process can increase manufacturing yield of the head 1*a* that can stably discharge the liquid.

As described-above, the head 1*a* includes the common chamber 18 to supply the liquid and the support substrate 202 includes the branch chambers 66 communicating with the nozzles 16 and the common chamber 18. The curved portion 70 is formed at the corner between the side face and the bottom face of the branch chamber 66 as illustrated in FIG. 2. Thus, the head 1*a* according to the present disclosure has as enhanced bubble discharging property and can prevent discharge failure or decrease in the discharge speed.

Next, another example of a head 1 according to the present disclosure is described with reference to FIGS. 4 to 10.

Figure 4:
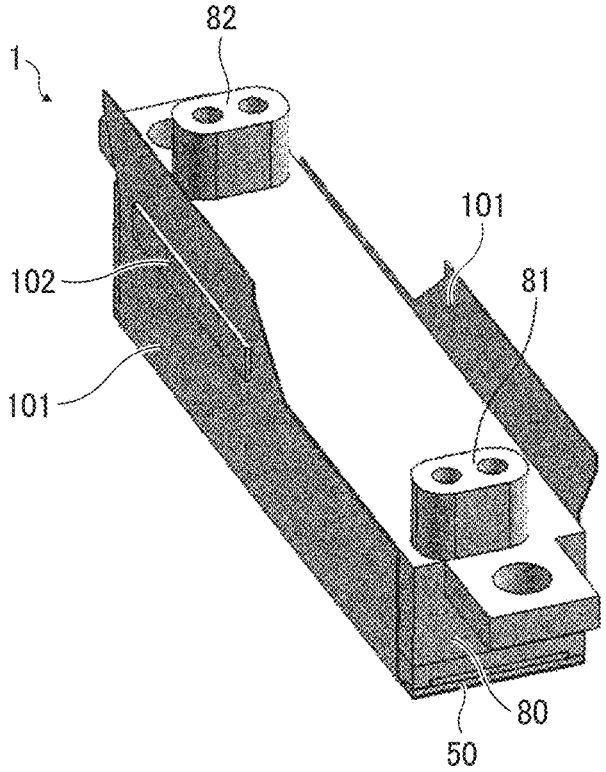
FIG. 4 is an outer perspective view of the liquid discharge head according to another example according to embodiments of the present disclosure.

FIG. 4 is an outer perspective view of the head 1.

Figure 5:
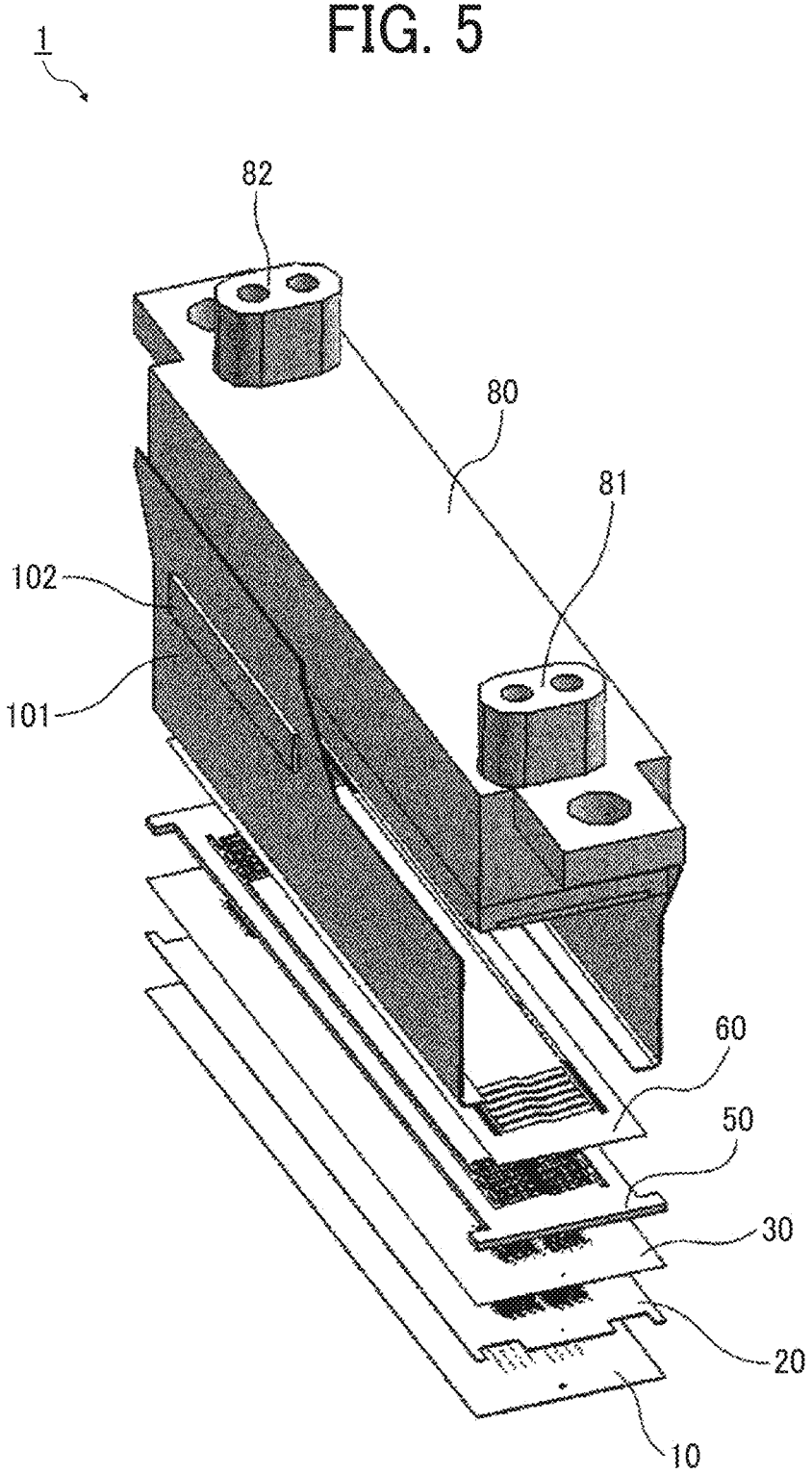
FIG. 5 is an exploded perspective view of another example of the liquid discharge head of FIG. 4.

FIG. 5 is an exploded perspective view of the head 1.

Figure 6:
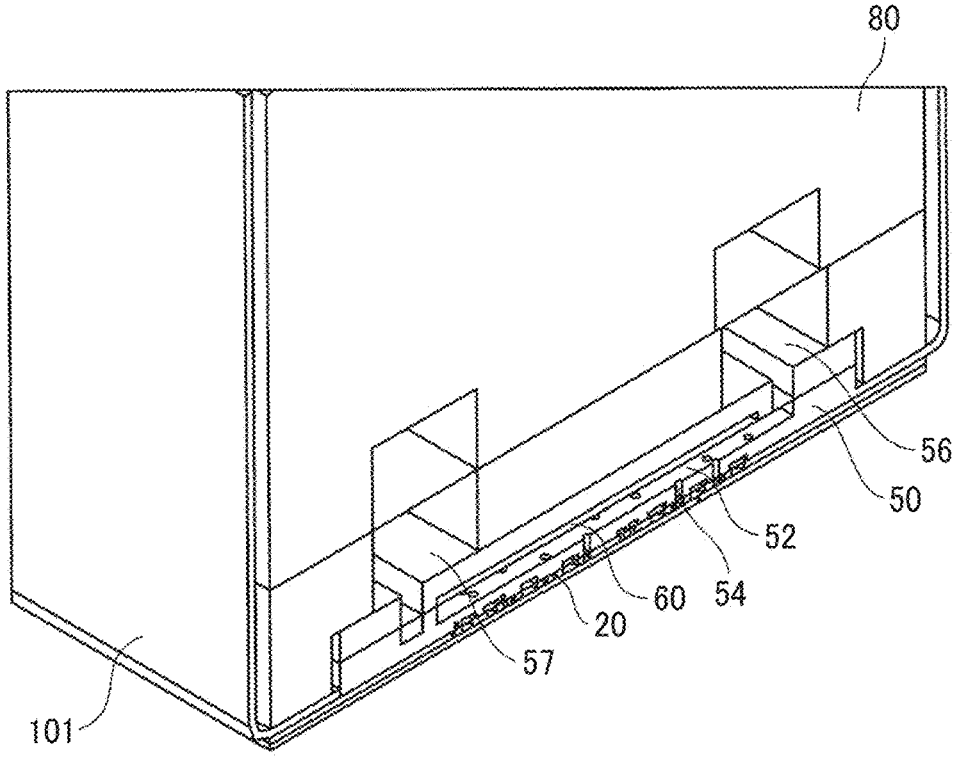
FIG. 6 is a cross-sectional perspective view of another example of the liquid discharge head of FIG. 4.

FIG. 6 is a cross-sectional view of the head 1.

Figure 7:
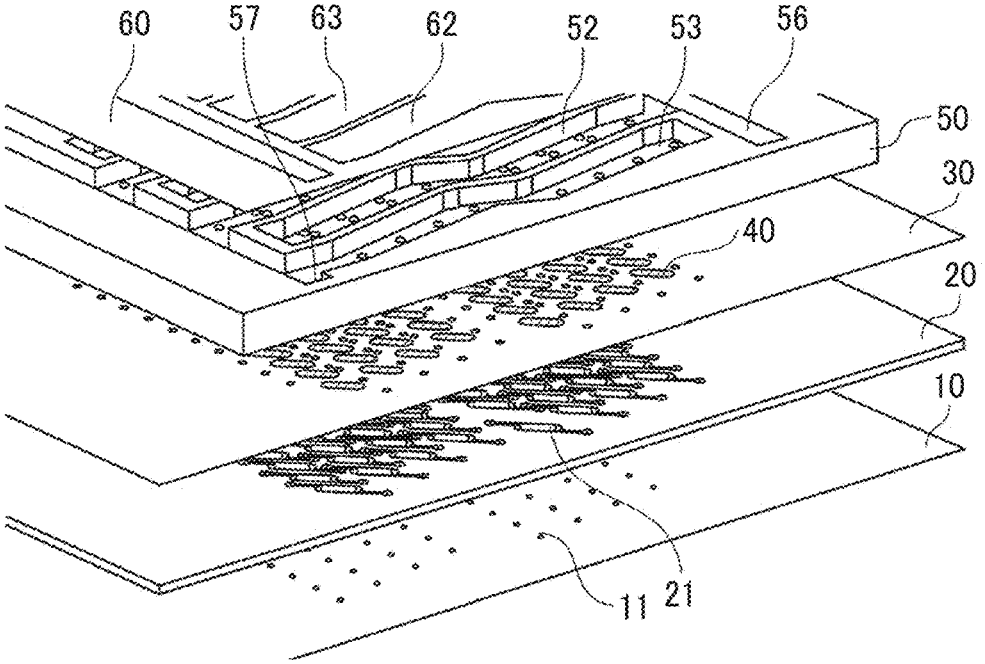
FIG. 7 is an exploded perspective view of another example of the liquid discharge head without a frame of FIG. 4.

FIG. 7 is an exploded perspective view of the head 1 excluding a frame.

Figure 8:
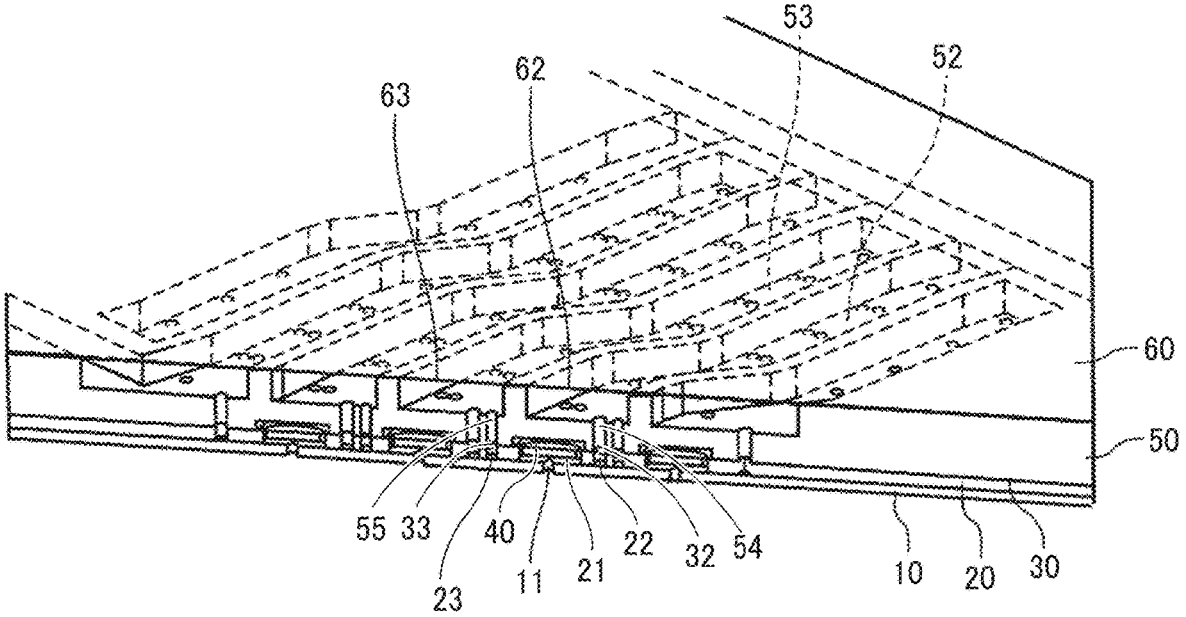
FIG. 8 is a cross-sectional perspective view of another example of channels.

FIG. 8 is a cross-sectional perspective view of channels and chambers of the head 1.

Figure 9:
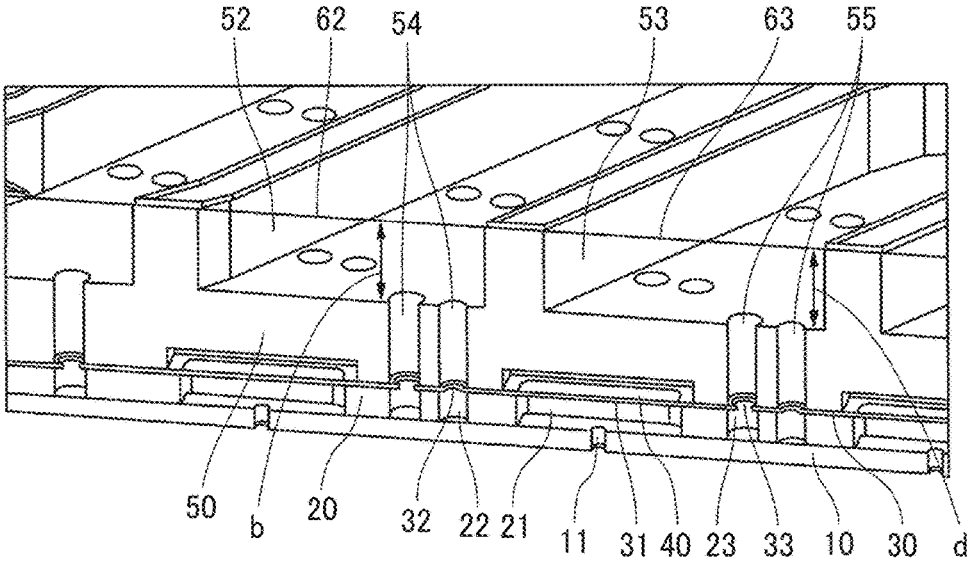
FIG. 9 is an enlarged cross-sectional perspective view of another example of the channels.

FIG. 9 is an enlarged cross-sectional perspective view of the channels and chambers of the head 1.

Figure 10:
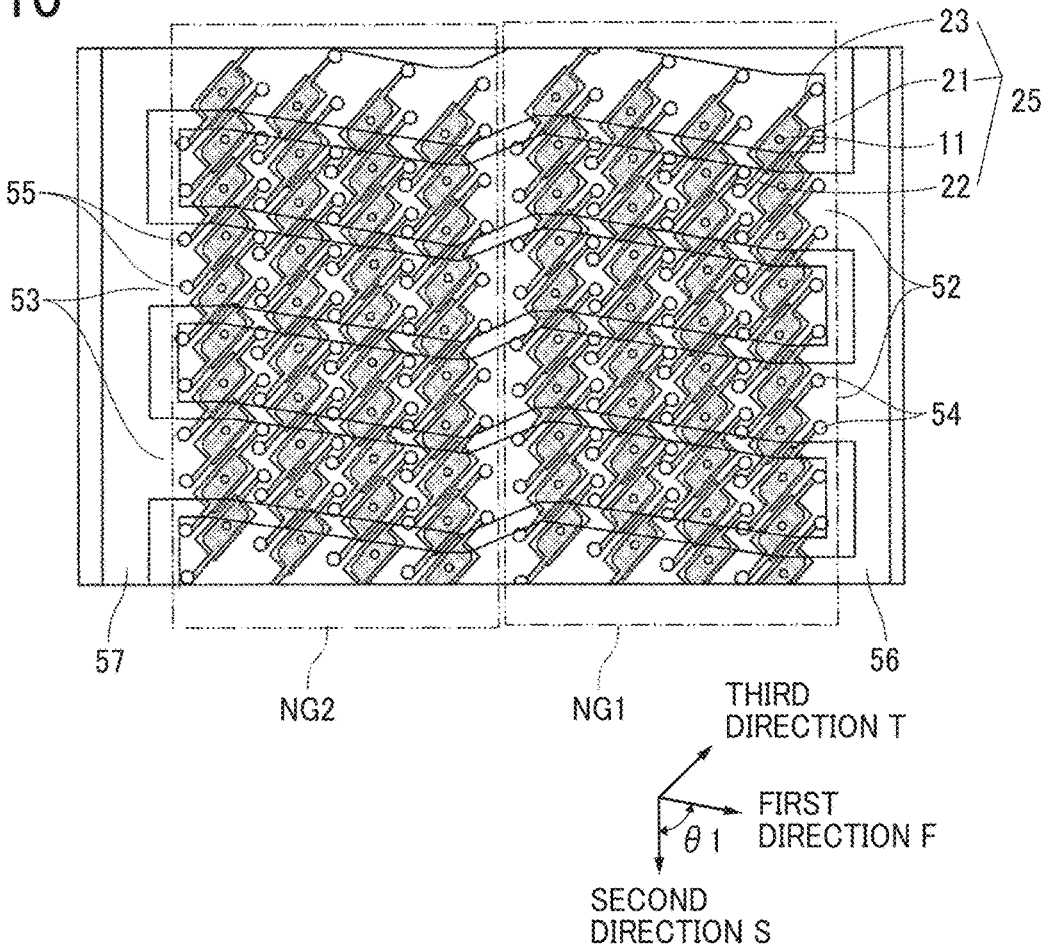
FIG. 10 is a plan view of another example of the channels.

FIG. 10 is a plan view of the channels and chambers of the head 1.

In FIGS. 4 to 10, the head 1 before the curved portion 70 is formed is illustrated.

The head 1 includes a nozzle plate 10, a channel plate (individual channel member 20), a diaphragm 30, a common channel member 50, a damper 60, a frame 80, and a substrate (flexible wiring substrate 101) mounting a drive circuit 102.

The nozzle plate 10 includes a plurality of nozzles 11 to discharge liquid. As illustrated in FIG. 10, the plurality of nozzles 11 are arranged two-dimensionally in a matrix and are arranged side by side in three directions of a first direction F, a second direction S and a third direction T.

The individual channel member 20 includes a plurality of pressure chambers 21 (individual chambers) respectively communicating with the plurality of nozzles 11, a plurality of individual supply channels 22 respectively communicating with the plurality of pressure chambers 21, and a plurality of individual collection channels 23 respectively communicating with the plurality of pressure chambers 21. A combination of one pressure chamber 21, one individual supply channel 22 communicating with one pressure chamber 21, and one individual collection channel 23 communicating with one pressure chamber 21 is collectively referred to as an individual channel 25.

The diaphragm 30 forms a diaphragm 31 serving as a deformable wall face of the pressure chamber 21, and the piezoelectric element 40 is formed on the diaphragm 31 to form a single body. Further, as illustrated in FIGS. 8 and 9, a supply opening 32 communicating with the individual supply channel 22 and a collection opening 33 communicating with the individual collection channel 23 are formed on the diaphragm 30. The piezoelectric element 40 is pressure generator to deform the diaphragm 31 to pressurize the liquid in the pressure chamber 21.

Note that the individual channel member 20 and the diaphragm 30 are not limited to separate members, and thus, for example, the same member, such as a Silicon on Insulator (SOI) substrate, may be used to form the individual channel member 20 and the diaphragm 30 as a single body. That is, an SOI substrate sequentially film-formed in an order of a silicon oxide film, a silicon layer, and a silicon oxide film on a silicon substrate is used for forming the individual channel member 20 and the diaphragm 30.

The silicon substrate in the SOI substrate forms the individual channel member 20, and the silicon oxide film, the silicon layer, and the silicon oxide film in the SOI substrate form the diaphragm 31. In the above-described configuration, the layer structure of the silicon oxide film, the silicon layer, and the silicon oxide film in the SOI substrate becomes the diaphragm 30. As described above, the diaphragm 30 includes a member made of the material that is film-formed on a surface of the individual channel member 20.

The common channel member 50 includes a plurality of common-supply branch channels 52 communicating with two or more individual supply channels 22 and a plurality of common-collection branch channels 53 communicating with two or more individual collection channels 23. The plurality of common-supply branch channels 52 and the plurality of common-collection branch channels 53 are alternately arranged adjacent to each other in the second direction S of the nozzles 11.

As illustrated in FIG. 9, the common channel member 50 includes a through-hole serving as a supply port 54 that connects the supply opening 32 of the individual supply channel 22 and the common-supply branch channel 52 and a through-hole serving as a collection port 55 that connects the collection opening 33 of the individual collection channel 23 and the common-collection branch channel 53.

Further, as illustrated in FIG. 6, the common channel member 50 includes one or more common-supply main channel 56 communicating with the plurality of common-supply branch channels 52 and one or more common-collection main channel 57 communicating with the plurality of common-collection branch channels 53.

The damper 60 includes a supply-side damper 62 that faces (opposes) the supply port 54 of the common-supply branch channel 52 and a collection-side damper 63 that faces (opposes) the collection port 55 of the common-collection branch channel 53.

As illustrated in FIG. 9, the common-supply branch channel 52 and the common-collection branch channel 53 are formed by sealing grooves with the supply-side damper 62 or the collection-side damper 63 of the damper 60. The grooves are alternately arranged in the common channel member 50 in which both of the common-supply branch channel 52 and the common-collection branch channel 53 are formed. As a material of the damper 60, it is preferable to use a metal thin film or an inorganic thin film resistant to an organic solvent. A thickness of the damper 60 of the supply-side damper 62 and the collection-side damper 63 is preferably 10 μm or less.

Figure 12:
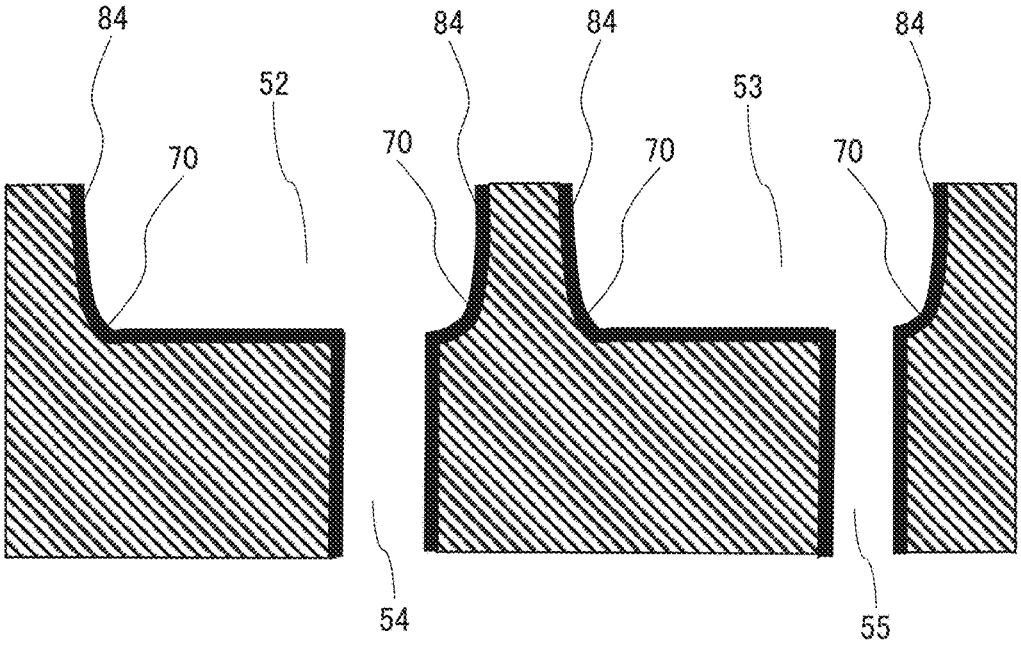
FIG. 12 is a schematic cross-sectional view of the example of the curved portion in the channels of the head.

As illustrated in FIG. 12, a protective film 84 (also referred to as a liquid contacting film) is formed on the inner wall surfaces (including the side face and the bottom face) of the common-supply branch channel 52 and the common-collection branch channel 53 and the inner wall surfaces (including the side face and the bottom face) of the common-supply main channel 56 and the common-collection main channel 57. The protective film 84 protects the inner wall surfaces from the liquid (ink, for example) flow in the channels in the head 1*a*.

For example, a silicon oxide film is formed on the inner wall surface of the common-supply branch channel 52 and the common-collection branch channel 53, and the inner wall surface of the common-supply main channel 56 and the common-collection main channel 57.

The common channel member 50 is made of a silicon (Si) substrate as a base material, and the silicon oxide film is formed by heat processing the Si substrate. The common channel member 50 includes the common-supply branch channels 52 and the common-supply main channel 56, and the common-collection branch channels 53 and the common-collection main channel 57. A tantalum silicon oxide film to protect a surface of the Si substrate from the ink is formed on the silicon oxide film.

The frame 80 includes a supply port 81 and a collection port 82 formed on a top surface of the frame 80. The supply port 81 supplies the liquid supplied from outside of the head 1 to the common-supply main channel 56. The collection port 82 discharges the liquid from the common-collection main channel 57 to outside of the head 1.

Next, the present embodiment including the curved portion 70 in the above-described head 1*a* is described below.

Figure 11:
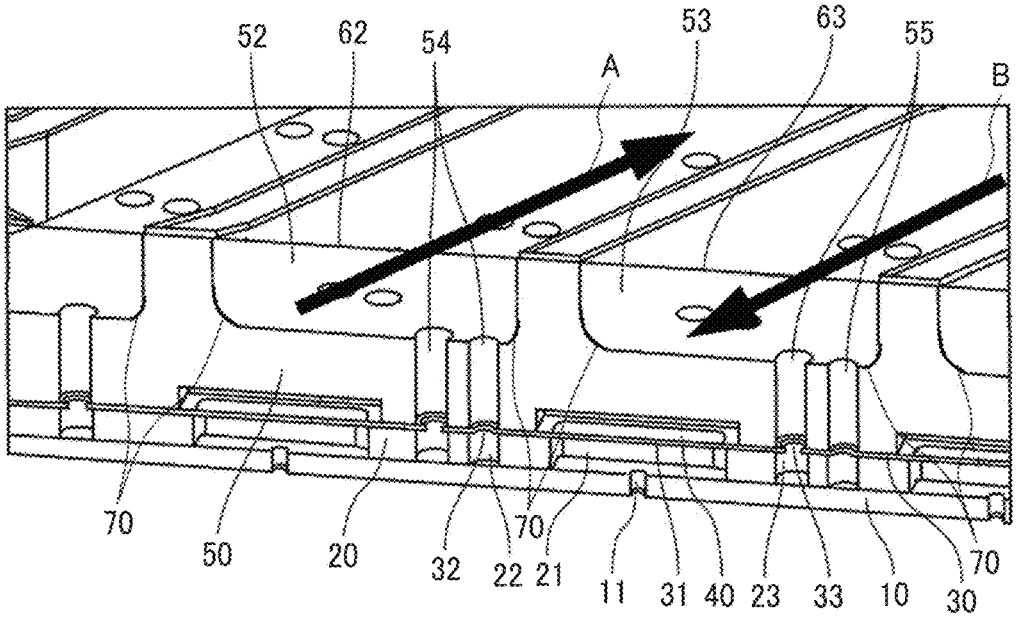
FIG. 11 is an enlarged schematic perspective view of an example of a curved portion formed in another example of the channels in the head.

FIG. 11 is a schematic perspective view of an example of the curved portion 70 formed in the channels in the head 1*a* described with reference to FIGS. 4 to 10.

FIG. 12 is a schematic cross-sectional view of an example of the curved portion 70 formed in the channels in the head 1*a*.

Figure 13:
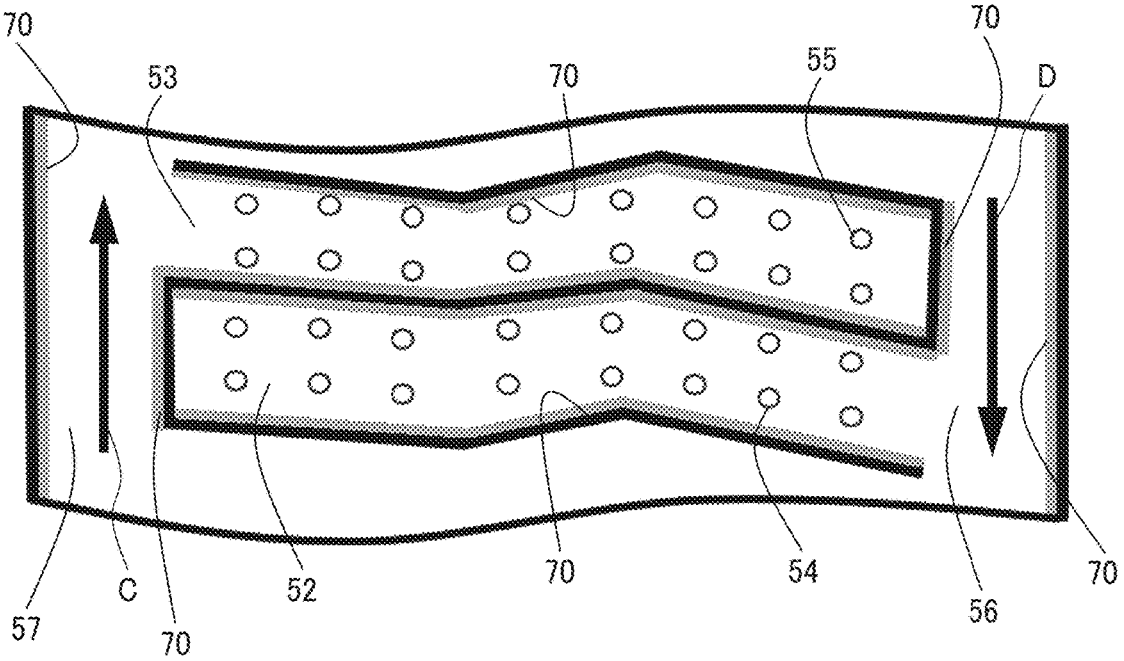
FIG. 13 is a schematic plan view of the example of the curved portion in the channels of the head.

FIG. 13 is a schematic plan view of an example of the curved portion 70 formed in the channels in the head 1*a*.

The curved portion 70 is formed at each corner between the side face and the bottom face of the common-supply branch channel 52 and at each corner between the side face and the bottom face of the common-collection branch channel 53. Thus, each of the plurality of common-supply branch channels 52 including a curved portion 70 on a corner between a side face and a bottom face of each of the plurality of common-supply branch channels 52 along a direction of liquid flow in the plurality of common-supply branch channels 52.

"Each corner" is also referred to as "each part between the side face and the bottom face". The curved portion 70 is formed to include the protective film 84 when the protective film 84 is formed on the inner wall surface of the channels as the channels illustrated in FIG. 12. Thus, the protective film 84 covers the curved portion 70 of each channel such as the common-supply branch channel 52 and the common-collection branch channel 53.

Here, "each part" is, for example, a corner formed by two surfaces. Alternatively, "each part" may be, for example, a part at which two surfaces intersects. Thus, the curved portion 70 is formed in "each part" between the side face and the bottom face of the common-supply branch channel 52 so that "each part" at which the side face and the bottom face intersects has a curved surface. Further, the corner having an acute angle formed between the side face and the bottom face disappears.

The curved portion 70 is formed at the corner between the side face and the bottom face along a direction of liquid flow (indicated by arrow A or B in FIG. 11) of the common-supply branch channel 52 and the common-collection branch channel 53. As illustrated in FIG. 13, the curved portion 70 is also formed at the corner between the side face and the bottom face along a direction of liquid flow (indicated by arrow C or D in FIG. 13) of the common-supply main channel 56 and the common-collection main channel 57.

Other variations of the channels of the head 1*a* including the curved portion 70 illustrated in FIGS. 11 to 13 are described below with reference to FIGS. 14 to 17. One or more of the following variations may be combined with each other.

First Variation

Figure 14:
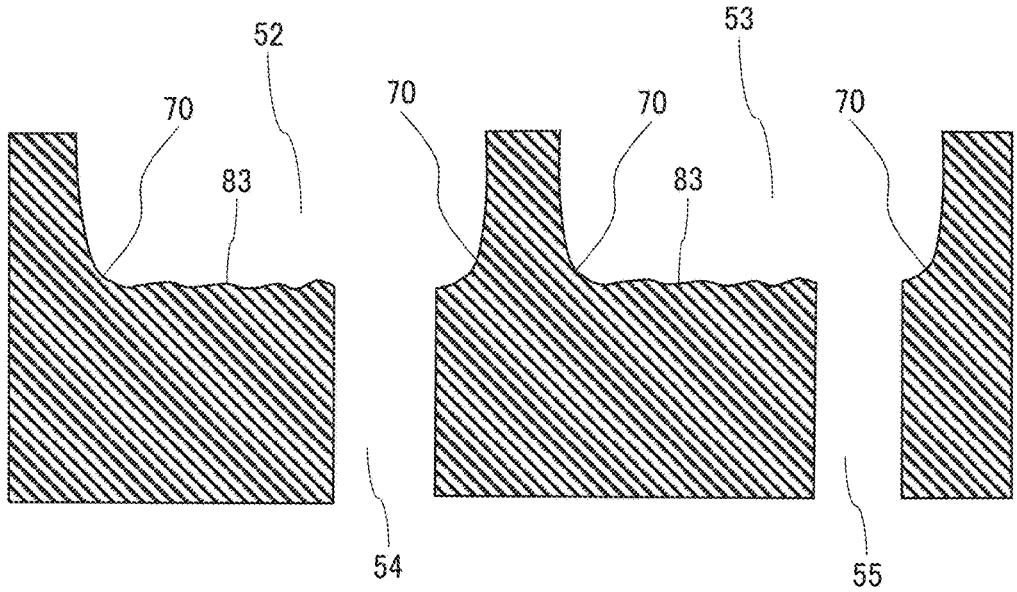
FIG. 14 is a schematic cross-sectional view of another example (first variation) of channels with a curved portion.

FIG. 14 is a schematic cross-sectional view of another example (first variation) of a channel portion provided with the curved portion. The bottom face of the common-supply branch channel 52 and the common-collection branch channel 53 is rougher than the side face of the common-supply branch channel 52 and the common-collection branch channel 53, respectively, as illustrated by a rough surface 83 in FIG. 14. Thus, the bottom face of one of the plurality of common-supply branch channels 52 is rougher than the side face of the one of the plurality of common-supply branch channels 52.

Thus, the protective film 84 can be further contact closely (adhere) to the bottom faces of the common-supply branch channel 52 and the common-collection branch channel 53. In FIG. 14, the protective film 84 illustrated in FIG. 12 is omitted to illustrate a roughness of the surface of the bottom face of each channel. Thus, an adhesion of the protective film 84 to the bottom face of each channel is improved. Thus, it is possible to prevent deformation of a shape of the curved portion 70 due to peeling of the protective film 84 from the bottom face or the like.

Second Variation

Figure 15:
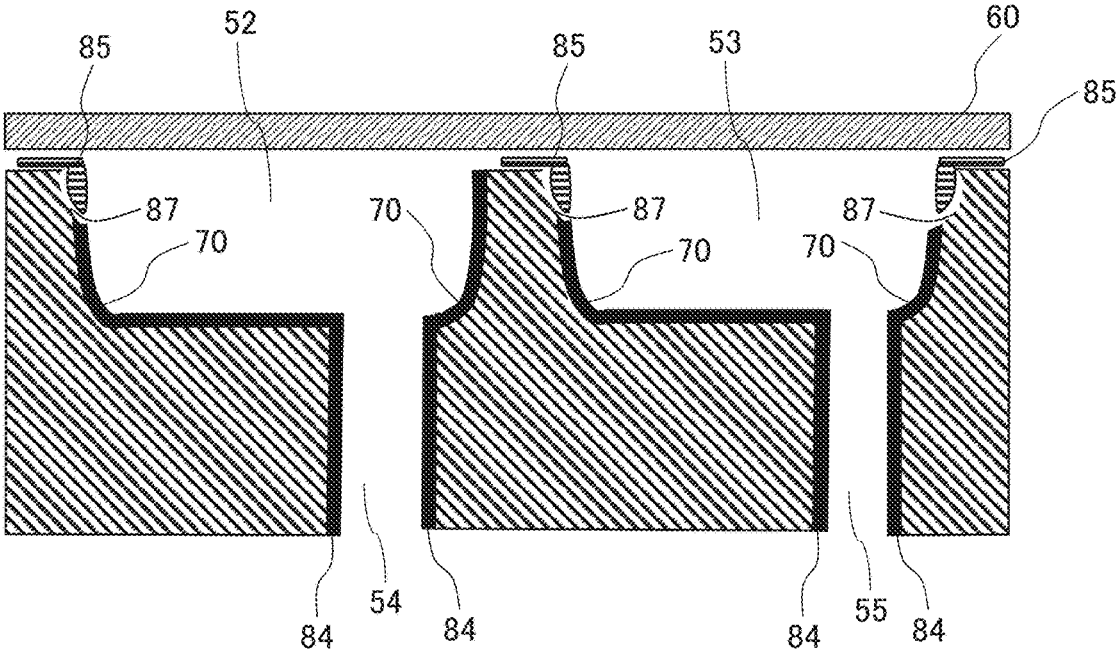
FIG. 15 is a schematic cross-sectional view of still another example (second variation) of channels with a curved portion.

FIG. 15 is a schematic cross-sectional view of still another example (second variation) of the channels including the curved portion 70. The damper 60 constitutes an upper face of the common-supply branch channel 52 and the common-collection branch channel 53 opposite (facing) the bottom face of the common-supply branch channel 52 and the common-collection branch channel 53. The damper 60 is bonded to the common channel member 50 with an adhesive 85.

A recess 87 (step) is formed at an edge of an opening of each of the common-supply branch channel 52 and the common-collection branch channel 53. The edge of the opening opposes (faces) to the damper 60 and is adjacent to the adhesive 85. Thus, the adhesive 85 at time of bonding the damper 60 flows into the recess 87. The recess 87 prevents the adhesive 85 from flowing onto the bottom face of the common-supply branch channel 52 and the common-collection branch channel 53. Thus, the recess 87 can prevent deformation of the curved portion 70 due to the adhesive 85 flowing into the curved portion 70.

Third Variation

Figure 16:
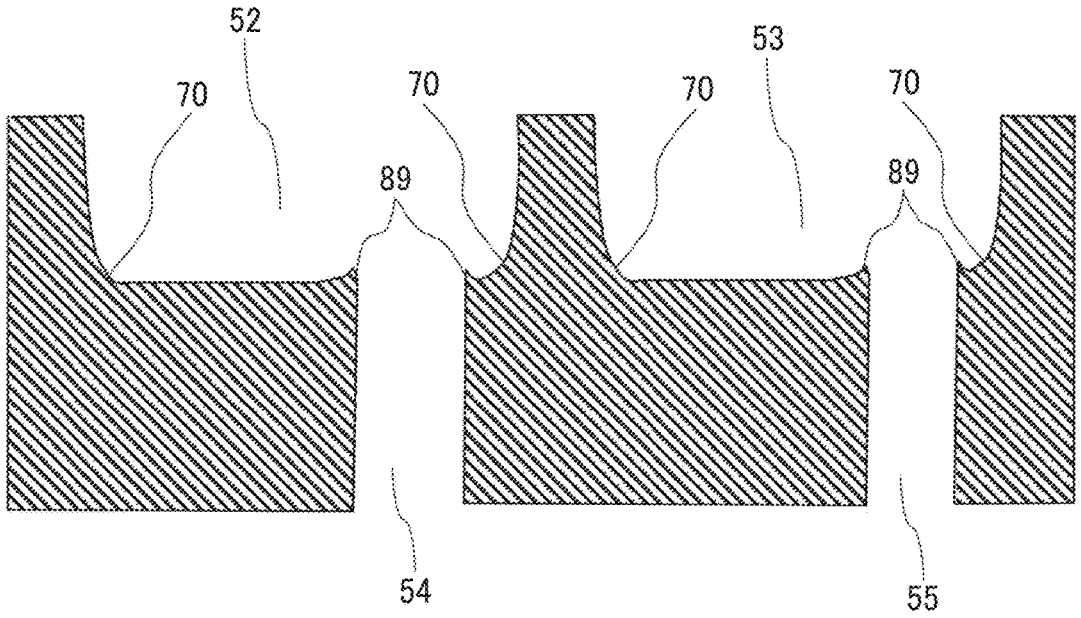
FIG. 16 is a schematic cross-sectional view of still another example (third variation) of channels with a curved portion.

FIG. 16 is a schematic cross-sectional view of still another example (third variation) of a channel portion provided with the curved portion.

In FIG. 16, a peripheral edge of the supply port 54 and a peripheral edge of the collection port 55 is raised to form a protrusion 89 having a sharply pointed tip. The protrusion 89 is formed on raised portions of the supply port 54 and the collection port 55. The supply port 54 is formed in the bottom face of the common-supply branch channel 52, and the collection port 55 is formed in the bottom face of the common-collection branch channel 53. The protrusion 89 surrounds each of the peripheral edge of the supply port 54 and the collection port 55.

Thus, bubbles in the common-supply branch channel 52 and the common-collection branch channel 53 contact the protrusion 89, whereby the bubble is divided into smaller bubbles, and the common-supply branch channel 52 and the common-collection branch channel 53. Bubbles are likely to be discharged from the inside of 53.

In FIG. 16, the protective film 84 illustrated in FIG. 12 is omitted to illustrate the protrusion 89 formed on the peripheral edge of the supply port 54 and the collection port 55.

Fourth Variation

Figure 17:
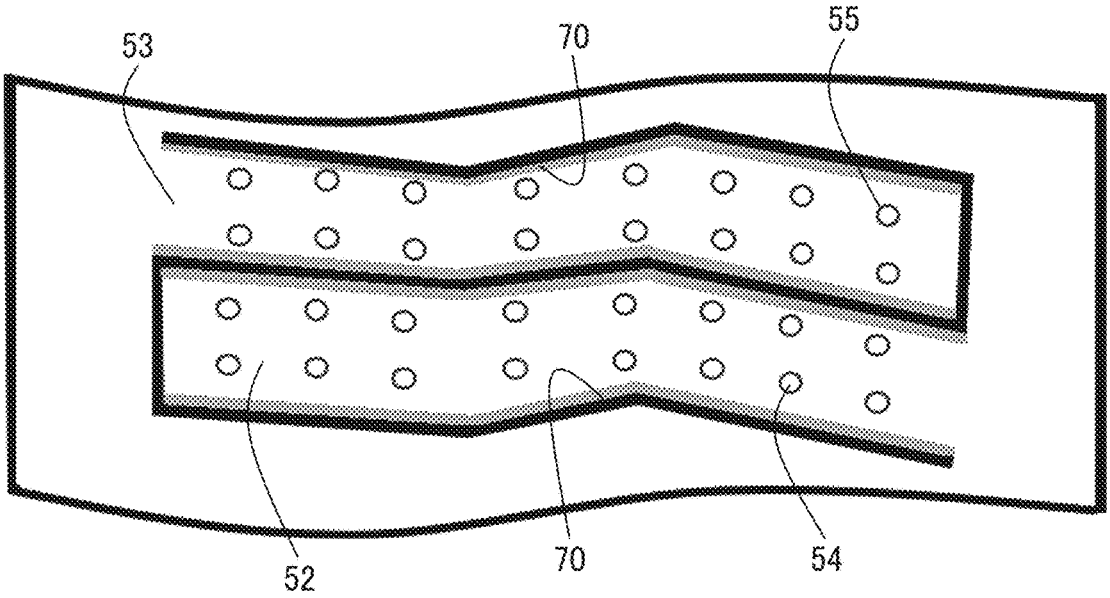
FIG. 17 is a schematic plan view of still another example (fourth variation) of channels with a curved portion.

FIG. 17 is a schematic plan view of another example (fourth variation) of a channel portion provided with the curved portion.

The supply port 54 formed in the bottom face of the common-supply branch channel 52 and the collection port 55 formed in the bottom face of the common-collection branch channel 53 are disposed in a region where the curved portion 70 is not formed.

Thus, the supply port 54 is formed in the bottom face of the common-supply branch channel 52 and is not formed in a region where the curved portion 70 is formed.

Thus, lengths of the through-holes of all the supply ports 54 formed in one common-supply branch channel 52 become identical. Thus, a fluid resistance of each supply ports 54 due to the lengths becomes constant. Similarly, the lengths of the through-holes of all the collection ports 55 formed in the common-collection branch channel 53 become identical, and a fluid resistance of each collection ports 55 due to the lengths becomes constant.

Head Module

Next, an example of a head module according to the present disclosure is described with reference to FIGS. 18 and 19.

Figure 18:
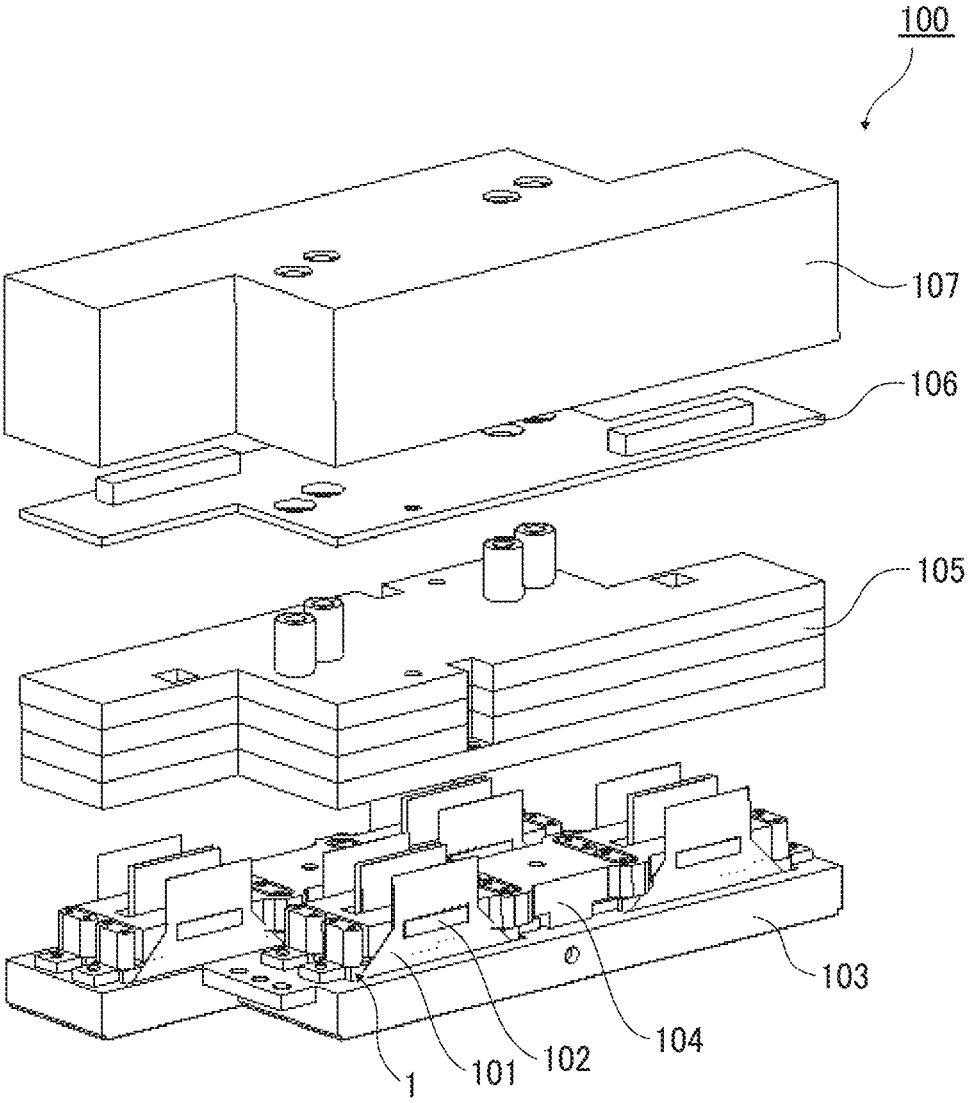
FIG. 18 is an exploded perspective view of a head module according to embodiments.

FIG. 18 is an exploded perspective view of the head module 100.

Figure 19:
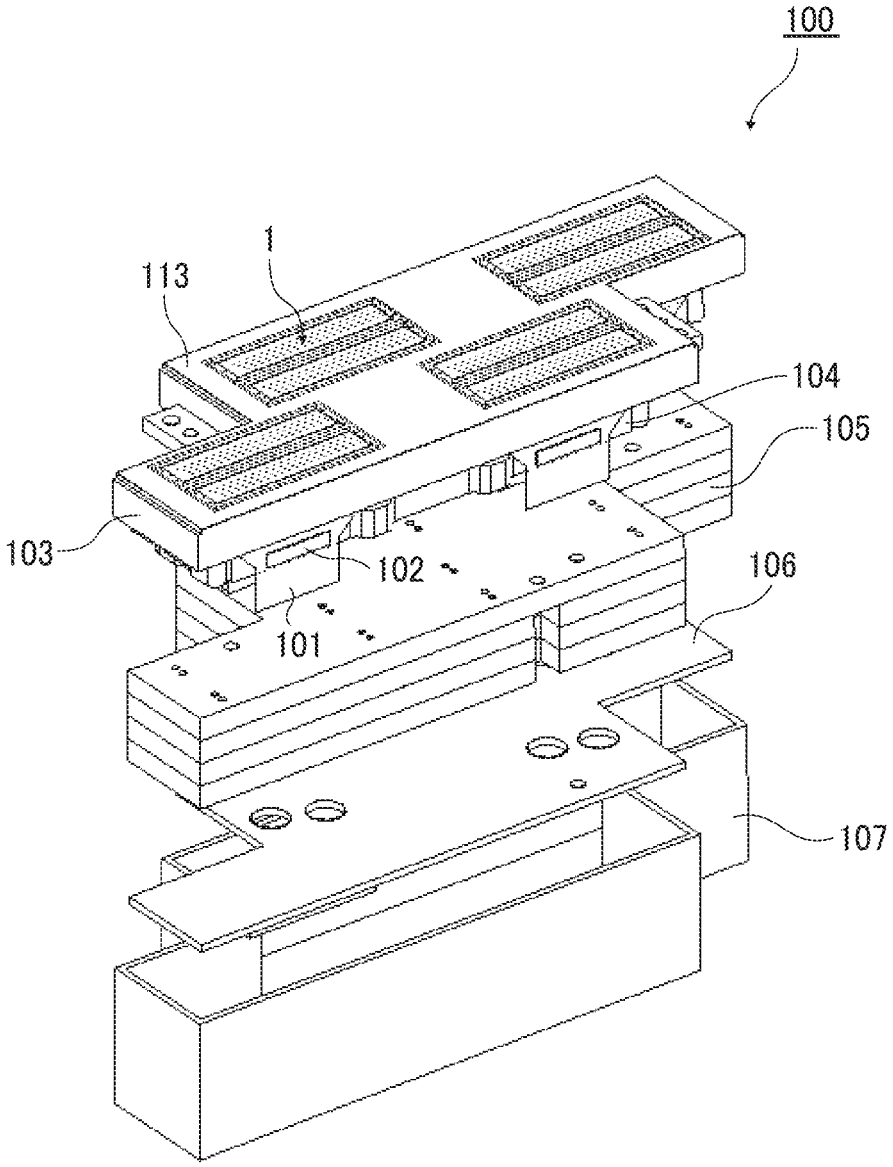
FIG. 19 is an exploded perspective view of the head module viewed from a nozzle surface of the head module.

FIG. 19 is an exploded perspective view of the head module 100 viewed from the nozzle surface side of the head module 100.

The head module 100 includes a plurality of heads 1 configured to discharge a liquid, a base 103 that holds the plurality of heads 1, and a cover 113 serving as a nozzle cover of the plurality of heads 1. Further, the head module 100 includes a heat radiator 104, a manifold 105 forming the channels to supply the liquid to the plurality of heads 1, a printed circuit board 106 (PCB) connected to the flexible wiring substrate 101, the drive circuit 102, and a module case 107.

Liquid Cartridge and Liquid Discharge Apparatus

An embodiment of a liquid cartridge and a liquid discharge apparatus mounting the liquid cartridge according to the present embodiment is described with reference to FIGS. 20 and 21. Following describes an ink cartridge and an inkjet recording apparatus using ink as a liquid cartridge and a liquid discharge apparatus.

Figure 20:
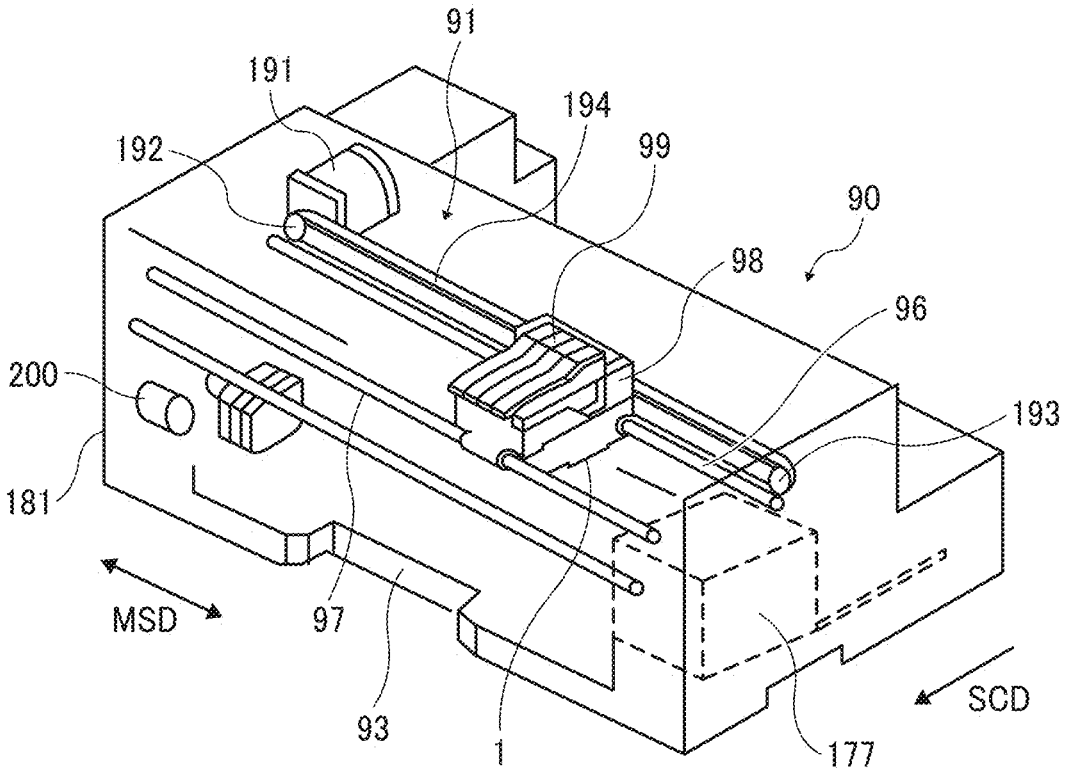
FIG. 20 is a perspective view of an example of an inkjet recording apparatus according to embodiments.

FIG. 20 is a schematic perspective view of an inkjet recording apparatus according to the present embodiment.

Figure 21:
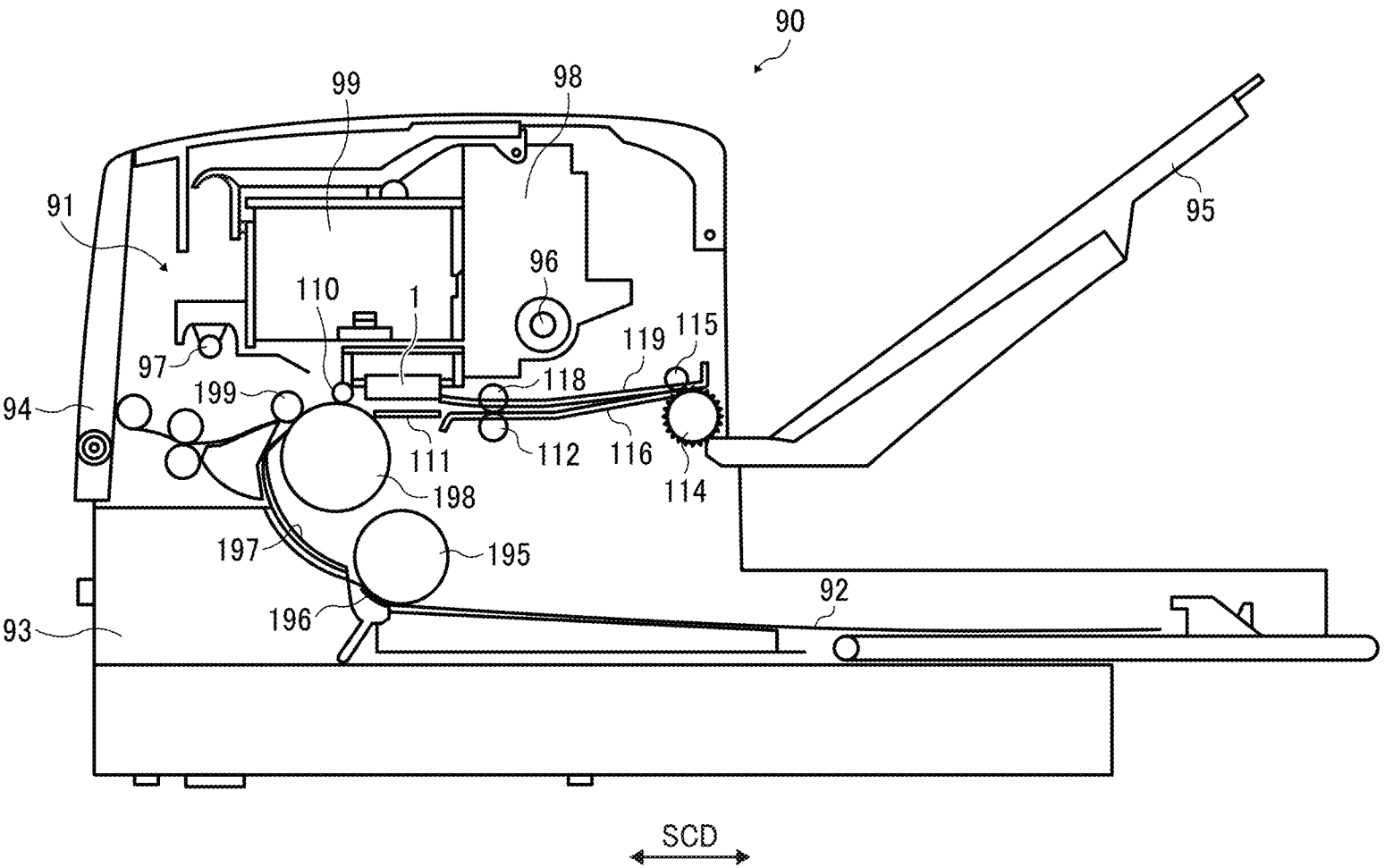
FIG. 21 is a side view of the example of the ink jet recording apparatus according to embodiments.

FIG. 21 is a cross-sectional side view of the inkjet recording apparatus of FIG. 20.

The inkjet recording apparatus 90 includes a carriage 98 movable in a main scanning direction inside an apparatus body 181, and a printing mechanism 91 including the heads 1 mounted on the carriage 98 and ink cartridges 99 that supplies ink to the heads 1. The heads 1 may be the head 1*a* illustrated in FIGS. 1 through 17 or the head 1 illustrated in FIGS. 18 and 19. The main scanning direction is indicated by arrow "MSD" in FIG. 20.

The inkjet recording apparatus 90 further includes a sheet feeding cassette 93 (sheet tray) to stack a large number of sheets 92 as recording media. The sheet feeding cassette 93 is attached to a lower portion of the apparatus body 181 in such a manner that the sheet feeding cassette 93 can be inserted into and removed from a front side of the apparatus body 181.

Further, the inkjet recording apparatus 90 includes a manual feed tray 94 to manually feed the sheets 92. Further, the sheets 92 fed from the sheet feeding cassette 93 or the manual feed tray 94 is taken into the apparatus body 181. After required image is recorded on the sheets 92 by the printing mechanism 91, the sheets 92 on which the image is recorded is ejected to a sheet ejection tray 95 mounted on a rear side of the inkjet recording apparatus 90.

The printing mechanism 91 holds the carriage 98 with a main guide rod 96 and a sub-guide rod 97 so that the carriage 98 is slidable in the main scanning direction MSD. The main guide rod 96 and the sub-guide rod 97 are guides laterally bridged between left and right side plates. The carriage 98 mounts the heads 1 that discharge droplets of yellow (Y), cyan (C), magenta (M), and black (K) inks, respectively.

The heads 1 each include nozzle arrays including nozzles 11 arranged in a direction intersecting the main scanning direction MSD. For example, the nozzles 11 are arranged in the second direction S illustrated in FIG. 10 that is the direction intersecting the main scanning direction MSD. The heads 1 are mounted on the carriage 98 so that the heads 1 discharge the ink downward. Further, the carriage 98 detachably mounts the ink cartridges 99 that supplies ink of the respective colors (Y, C, M, K) to the heads 1.

Each of the ink cartridges 99 has an atmosphere communication port, a supply port, and a porous body. The atmosphere communication port is disposed at an upper portion of the ink cartridge 99 to communicate with the atmosphere. The supply port is disposed at a lower portion of the ink cartridge 99 to supply ink to the heads 1. The porous body is disposed inside the ink cartridge 99 to be filled with ink. Ink to be supplied to the heads 1 is kept at a slight negative pressure by capillary force of the porous body. In the present embodiment, four heads 1 discharges colors of yellow (Y), cyan (C), magenta (M), and black (K), respectively. However, a single head 1 having nozzles 11 to discharge ink droplets of four colors of yellow (Y), cyan (C), magenta (M), and black (K) may be used.

Here, the carriage 98 is slidably fitted to the main guide rod 96 on a rear side of the apparatus body 181 (downstream side in a sheet conveyance direction indicated by arrow SCD in FIGS. 20 and 21) and is slidably fitted to the sub-guide rod 97 on a front side of the apparatus body 181 (upstream side in the sheet conveyance direction SCD).

A timing belt 194 is stretched between a driving pulley 192 and a driven pulley 193 rotationally driven by the main scanning motor 191 to move and scan the carriage 98 in the main scanning direction MSD. The timing belt 194 is secured to the carriage 98. The carriage 98 is reciprocally moved by forward and reverse rotations of the main scanning motor 191.

The inkjet recording apparatus 90 further includes a sheet feed roller 195, a friction pad 196, a guide 197, conveyance rollers 198 and 199, and leading end roller 110. The sheet feed roller 195 and the friction pad 196 separate the sheet 92 and feed the sheet 92 set in the sheet feeding cassette 93 to the printing mechanism 91. The guide 197 guides the sheet 92. The conveyance rollers 198 and 199 reverses and conveys the sheet 92 to the printing mechanism 91. The conveyance roller 199 is pressed against a circumferential surface of the conveyance roller 198. The leading end roller 110 regulates a feeding angle of the sheet 92 from the conveyance roller 198. The conveyance roller 198 is rotationally driven via a gear train by a sub-scanning motor 200.

A print receiver 111 as a sheet guide is provided to guide the sheet 92 fed from the conveyance roller 198 below the heads 1 in accordance with the movement range of the carriage 98 in the main scanning direction MSD. The inkjet recording apparatus 90 includes a conveyance roller 112 and a spur roller 118 on the downstream side of the print receiver 109 in the sheet conveyance direction SCD. The conveyance roller 112 and the spur roller 118 are driven to rotate to feed the sheet 92 in the sheet conveyance direction SCD (sheet ejection direction) toward the sheet ejection tray 95. The inkjet recording apparatus 90 further includes a sheet ejection roller 114 and a spur roller 115 to feed the sheet 92 to the sheet ejection tray 95 and guides 116 and 119 constituting a sheet ejection passage.

In recording, the inkjet recording apparatus 90 drives the heads 1 in response to image signals while moving the carriage 98, discharges ink to the stopped sheet 92 to record one line of a desired image on the sheet 92, feeds the sheet 92 in a predetermined amount, and then records a next line on the sheet 92. When the inkjet recording apparatus 90 receives a signal indicating an end of recording operation or a signal indicating that a rear end of the sheet 92 has reached a recording area, the inkjet recording apparatus 90 terminates a recording operation and ejects the sheet 92.

A maintenance unit 117 to recover the heads 1 from discharge failure is disposed at a position out of the recording area on a right end side in the moving direction (main scanning direction MSD) of the carriage 98 (see FIG. 20). The maintenance unit 117 has a cap, a suction unit, and a cleaner such as a wiper. While waiting for printing, the carriage 98 moves to the maintenance unit 117.

The maintenance unit 117 caps the head 1 with the cap to keep the nozzles 11 in a wet state to prevent occurrence of discharge failure due to ink drying. Further, because the inkjet recording apparatus 90 discharges ink irrelevant to printing during recording or the like, the viscosity of ink in all the nozzles 11 is kept constant. Thus, the inkjet recording apparatus 90 can stably discharge the liquid.

When the discharge failure occurs, the nozzles 11 of the heads 1 are sealed with the cap, and ink and bubbles in the nozzles 11 are suctioned out by the suction unit through a tube. The cleaner (wiper) removes ink and dusts adhered to a nozzle face, in which nozzles 11 are formed, of the head 1, thus recovering the head 1 from the discharge failure. The suctioned ink is drained to a waste ink container disposed on a lower portion of the apparatus body 181, absorbed into an ink absorber in the waste ink container, and held in the ink absorber.

As described above, the inkjet recording apparatus 90 according to the present embodiment mounts the heads 1 or 1*a* as described above. Thus, the inkjet recording apparatus 90 can have stable ink discharge characteristics and improve image quality.

Although the above-described embodiments describe the head 1 used to the inkjet recording apparatus 90, the head 1 may be used to a device that discharges liquid other than ink, for example, a liquid resist for patterning.

Thus, the head 1 according to the present disclosure has as enhanced bubble discharging property and can prevent discharge failure or decrease in the discharge speed. As described above, the ink cartridge 99 and inkjet recording apparatus 90 including the head 1 according to the present embodiment can stably obtain high-quality image.

Liquid Discharge Head and Liquid Discharge Apparatus

Next, embodiments of the head and the liquid discharge apparatus including the head according to the present embodiment are described below with reference to FIGS. 22 to 23.

Figure 22:
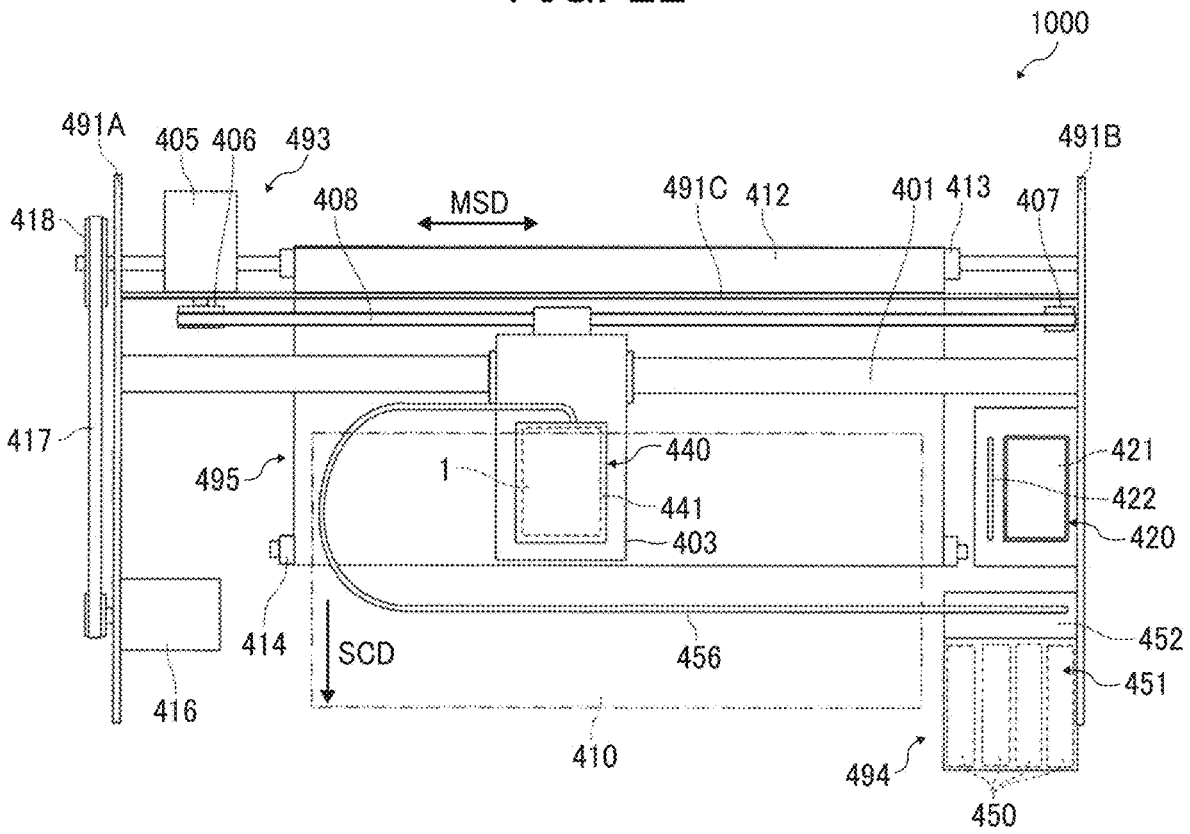
FIG. 22 is a plan view of an example of a main part of a liquid discharge apparatus including a liquid discharge head according to embodiments.

FIG. 22 is a plan view of an example of a liquid discharge apparatus including the head according to the present embodiment. FIG. 23 is a side view of an example of a main part of the liquid discharge apparatus of FIG. 22.

The liquid discharge apparatus 1000 according to the present embodiment is a serial-type apparatus in which a main scan moving unit 493 reciprocally moves a carriage 403 in a main scanning direction indicated by arrow MSD in FIG. 22. The main scan moving unit 493 includes a guide 401, a main scanning motor 405, and a timing belt 408, for example. The guide 401 is bridged between a left side plate 491A and a right side plate 491B that movably holds the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 1 according to the present embodiment and a head tank 441 forms the liquid discharge device 440 as a single unit. The head 1 or 1*a* as illustrated in FIGS. 1 through 21 may be used as the head 1 in FIGS. 22 and 23. The head 1 of the liquid discharge device 440 discharges liquid of each color, for example, yellow (Y), cyan (C), magenta (M), and black (K).

The head 1 includes nozzle arrays each including a plurality of nozzles 11 arrayed in row in a sheet conveyance direction SCD in FIG. 28, perpendicular to the main scanning direction MSD. The head 1 is mounted to the carriage 403 so that the liquid droplets are discharged downward.

The liquid stored in the liquid cartridges 450 is supplied to the head tank 441 by a supply unit 494 that supplies the liquid stored outside the head 1 to the head 1.

The supply unit 494 includes a cartridge holder 451 which is a filling section to mount the liquid cartridges 450, a tube 456, a liquid feed unit 452 including a liquid feed pump, and the like. The liquid cartridges 450 are detachably attached to the cartridge holder 451. The liquid is supplied to the head tank 441 by the liquid feed unit 452 via the tube 456 from the liquid cartridges 450.

The liquid discharge apparatus 1000 in the present embodiment includes a conveyance unit 495 to convey the sheet 410 as a recording medium. The conveyance unit 495 includes a conveyance belt 412 as a conveyance unit and a sub-scanning motor 416 to drive the conveyance belt 412.

The conveyance belt 412 attracts the sheet 410 and conveys the sheet 410 at a position facing the head 1. The conveyance belt 412 is an endless belt and is stretched between a conveyance roller 413 and a tension roller 414. The adsorption of the sheet 410 by the conveyance belt 412 can be performed by electrostatic adsorption, air adsorption, or the like.

The conveyance roller 413 is driven and rotated by the sub-scanning motor 416 via a timing belt 417 and a timing pulley 418, so that the conveyance belt 412 circulates in the sheet conveyance direction SCD.

At one side in the main scanning direction MSD of the carriage 403, a maintenance unit 420 to maintain and recover the head 1 in good condition is disposed on a lateral side of the conveyance belt 412. The maintenance unit 420 is composed of, for example, a cap 421 for capping the nozzle surface (the surface on which the nozzles 11 are formed) of the head 1, a wiper 422 for wiping the nozzle surface, and the like.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sheet conveyance direction SCD by the cyclic rotation of the conveyance belt 412.

The head 1 is driven in response to image signals while the carriage 403 moves in the main scanning direction MSD, to discharge liquid to the sheet 410 stopped, thus forming an image on the sheet 410.

As described above, the liquid discharge apparatus 1000 includes the head 1 according to the present embodiment, thus allowing stable formation of high quality images.

Next, another embodiment of the liquid discharge device according to the present disclosure is described below with reference to FIG. 24.

Figure 23:
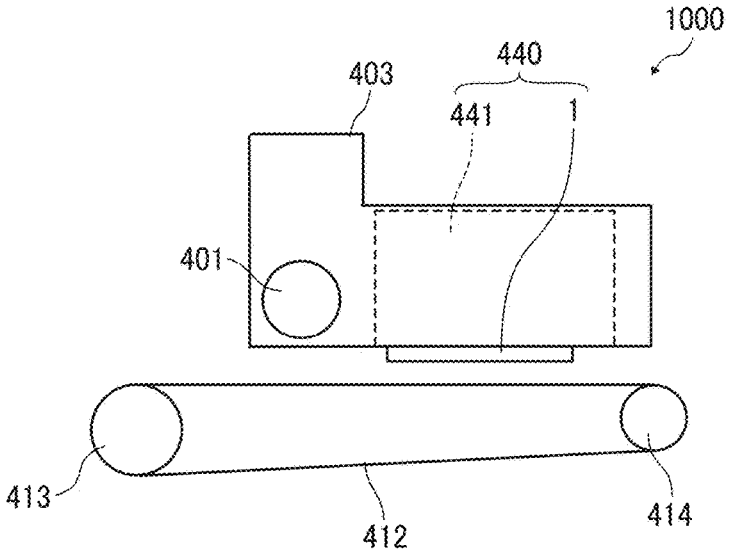
FIG. 23 is a side view of the example of the main part of the liquid discharge apparatus including the liquid discharge head according to embodiments.
Figure 24:
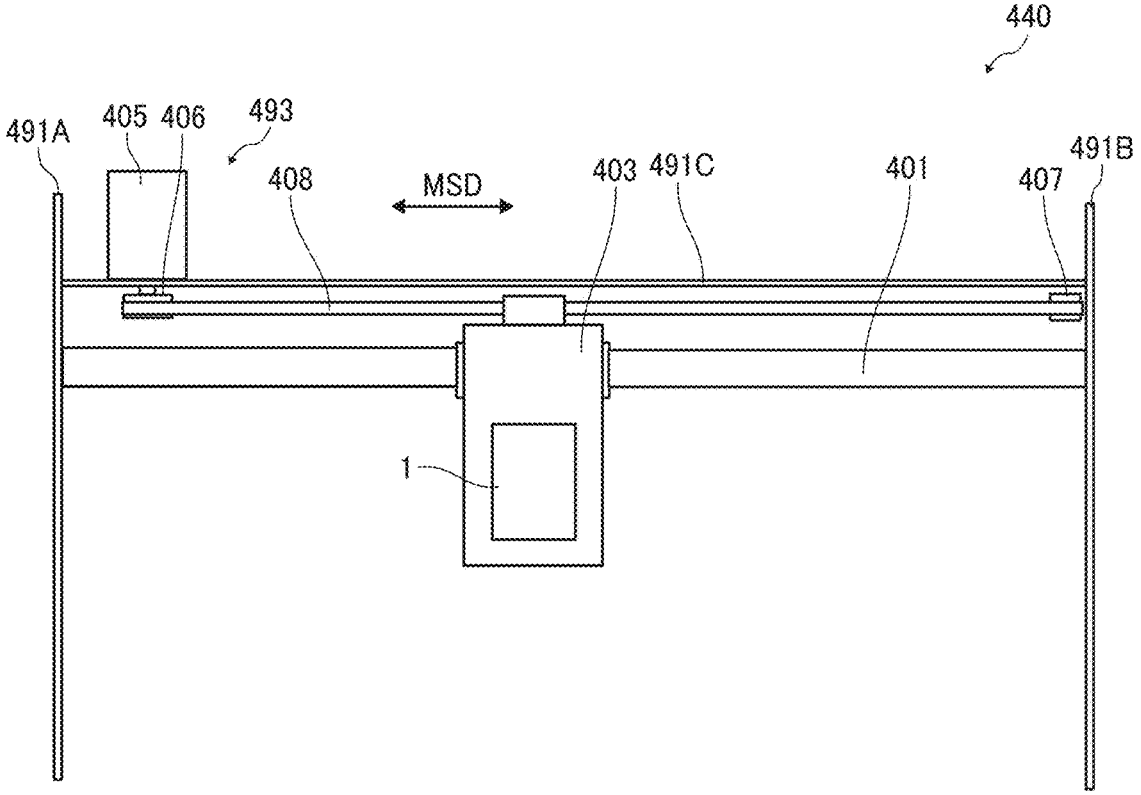
FIG. 24 is a plan view of an example of a liquid discharge device according to another embodiment of the present disclosure.

FIG. 24 is a plan view of an example of the liquid discharge device 440 according to the present embodiment. The liquid discharge device 440 includes a housing, the main scan moving unit 493, the carriage 403, and the head 1 among components of the liquid discharge apparatus 1000 as illustrated in FIG. 23. The left side plate 491A, the right side plate 491B, and the rear side plate 491C forms the housing. Note that, in the liquid discharge device 440, at least one of the maintenance unit 420 and the supply unit 494 may be mounted on, for example, the right side plate 491B.

Next, another embodiment of the liquid discharge device 440 according to the present disclosure is described below with reference to FIG. 25.

Figure 25:
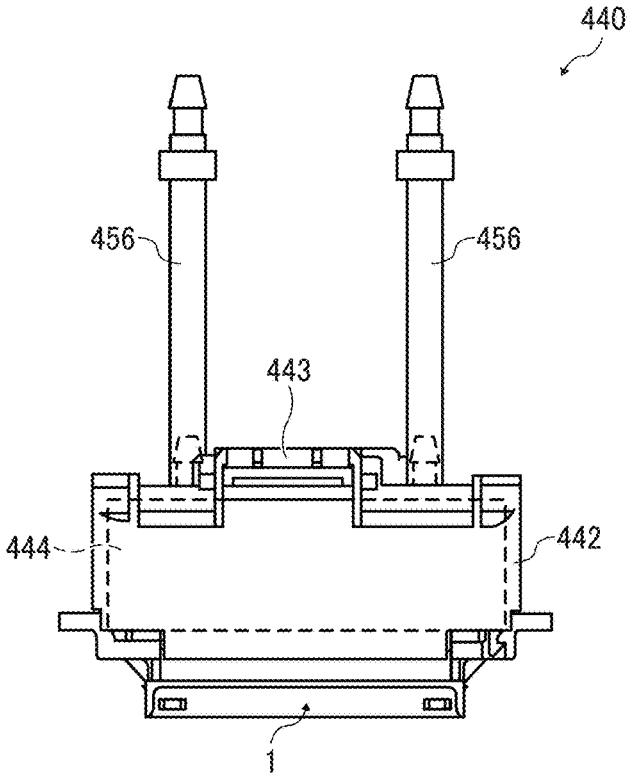
FIG. 25 is a front view of another example of a liquid discharge device according to another embodiment of the present disclosure.

FIG. 25 is a plan view of another example of the liquid discharge device 440 according to the present embodiment. The liquid discharge device 440 includes the head 1 to which a channel part 444 is mounted, and tubes 456 connected to the channel part 444. Further, the channel part 444 is disposed inside a cover 442. Instead of the channel part 444, the liquid discharge device 440 may include the head tank 441 as illustrated in FIG. 23. A connector 443 electrically connected with the head 1 is provided on an upper part of the channel part 444.

The liquid discharge apparatus 1000 according to the present embodiment includes the head 1 or the liquid discharge device 440 and drives the head 1 to discharge the liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an apparatus to form an image on a sheet by discharging ink, or a three-dimensional fabrication apparatus to discharge a fabrication liquid to a powder layer in which powder material is formed in layers to form a three-dimensional fabrication object.

Further, the liquid discharge apparatus is not limited to one in which significant images such as letters and graphics are visualized by the ejected liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, ceramic, construction materials (e.g., wall paper or floor material), and cloth textile.

Examples of the "liquid" are, e.g., ink, treatment liquid, DNA sample, resist, pattern material, binder, fabrication liquid, or solution and dispersion liquid including amino acid, protein, or calcium.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, and a main scan moving unit.

Examples of the "single unit" include a combination in which the head and one or more functional parts and devices are secured to each other through, e.g., fastening, bonding, or engaging, and a combination in which one of the head and the functional parts and devices is movably held by another. The head may be detachably attached to the functional part(s) or device(s) each other.

The liquid discharge device may be, for example, formed by the head and the head tank as a single head, such as the liquid discharge device 440 illustrated in FIG. 23. Alternatively, the head and the head tank coupled (connected) with a tube or the like may form the liquid discharge device as a single unit. A unit including a filter may be added at a position between the head tank and the head of the liquid discharge device.

The head and the carriage may form the "liquid discharge device" as a single unit.

In still another example, the liquid discharge device includes the head movably held by a guide that forms part of a main scan moving unit, so that the head and the main scan moving unit form a single unit. The head, the carriage, and the main scan moving unit may form the liquid discharge device as a single unit.

In still another example, the cap that forms part of the maintenance unit may be secured to the carriage mounting the head so that the head, the carriage, and the maintenance unit form a single unit as the liquid discharge device.

Further, a tube may be coupled to the head to which either the head tank or a channel member is attached, so that the head and the supply unit form a single liquid discharge device.

The main scan moving unit may be a guide only. The supply device may include only a tube(s) or a loading unit.

The pressure generator used in the head is not limited to a particular-type of pressure generator. The pressure generator is not limited to the piezoelectric actuator (or a laminated piezoelectric element) described in the above-described embodiments, and may be, for example, a thermal actuator that employs an electrothermal transducer element, such as a thermal resistor, or an electrostatic actuator including a diaphragm and opposed electrodes.

The terms "image formation", "recording", "printing", "image printing", and "fabricating" used herein may be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head comprising: a plurality of nozzles to discharge a liquid; a plurality of pressure chambers communicating with the plurality of nozzles, respectively; a plurality of individual supply channels communicating with the plurality of pressure chambers, respectively; a plurality of common-supply branch channels each having a side face and a bottom face and communicating with two or more of the plurality of individual supply channels, respectively, each of the plurality of common-supply branch channels made of one solid piece with a curved portion on a corner between the side face and the bottom face along a direction of liquid flow in the plurality of common-supply branch channels; and a common-supply main channel communicating with the plurality of common-supply branch channels.

2. The liquid discharge head according to claim 1, wherein the common-supply main channel has a side face, a bottom face, and a curved portion formed on a corner between the side face and the bottom face.

3. The liquid discharge head according to claim 1, further comprising a common channel member made of a silicon substrate, the common channel member including the plurality of common-supply branch channels and the common-supply main channel.

4. The liquid discharge head according to claim 3, further comprising:

a damper forming an upper face of each of the plurality of common-supply branch channels facing the bottom face of each of the plurality of common-supply branch channels, the damper being bonded to the common channel member with an adhesive; and a recess formed at an edge of an opening of each of the plurality of common-supply branch channels.

5. The liquid discharge head according to claim 1, further comprising a protective film on the side face and the bottom face of each of the plurality of common-supply branch channels to protect the side face and the bottom face of each of the plurality of common-supply branch channels from the liquid, wherein the protective film covers the curved portion.

6. The liquid discharge head according to claim 1, wherein a bottom face of one of the plurality of common-supply branch channels is rougher than a side face of the one of the plurality of common-supply branch channels.

7. A liquid discharge device comprising the liquid discharge head according to claim 1.

8. The liquid discharge device according to claim 7, wherein the liquid discharge head and at least one of a head tank to store the liquid to be supplied to the liquid discharge head, a carriage on which the liquid discharge head is mounted, a supply unit to supply the liquid to the liquid discharge head, a maintenance unit to maintain the liquid discharge head, and a main scan moving unit to move the liquid discharge head in a main scanning direction form the liquid discharge device as a single unit.

9. A liquid discharge apparatus comprising the liquid discharge head according to claim 1.

10. A liquid discharge head comprising:

a plurality of nozzles to discharge a liquid;

a plurality of pressure chambers communicating with the plurality of nozzles, respectively;

a plurality of individual supply channels communicating with the plurality of pressure chambers, respectively:

a plurality of common-supply branch channels each having a side face and a bottom face and communicating with two or more of the plurality of individual supply channels, respectively, each of the plurality of common-supply branch channels including a curved portion on a corner between the side face and the bottom face of each of the plurality of common-supply branch channels along a direction of liquid flow in the plurality of common-supply branch channels; and a common-supply main channel communicating with the plurality of common-supply branch channels;

a supply port formed in the bottom face of each of the plurality of common-supply branch channels; and a protrusion formed around a peripheral edge of the supply port.

11. The liquid discharge head according to claim 10, wherein the protrusion has a pointed tip.

12. The liquid discharge head according to claim 10, wherein the supply port is formed in the bottom face of each of the plurality of common-supply branch channels and is not formed in a region where the curved portion is formed.

13. A liquid discharge head comprising:

a plurality of nozzles to discharge a liquid;

a plurality of pressure chambers communicating with the plurality of nozzles, respectively;

a plurality of individual supply channels communicating with the plurality of pressure chambers, respectively;

a plurality of common-supply branch channels each having a side face and a bottom face and communicating with two or more of the plurality of individual supply channels, respectively, each of the plurality of common-supply branch channels including a curved portion on a corner between the side face and the bottom face of each of the plurality of common-supply branch channels along a direction of liquid flow in the plurality of common-supply branch channels; and a common-supply main channel communicating with the plurality of common-supply branch channels;

a plurality of individual collection channels communicating with the plurality of pressure chambers, respectively;

a plurality of common-collection branch channels each having a side face and a bottom face and communicating with two or more of the plurality of individual collection channels, respectively, each of the plurality of common-collection branch channels including a curved portion on a corner between the side face and the bottom face of each of the plurality of common-collection branch channels along a direction of liquid flow in the plurality of common-collection branch channels; and a common-collection main channel communicating with the plurality of common-collection branch channels.

14. The liquid discharge head according to claim 13, wherein the common-collection main channel has a side face, a bottom face, and a curved portion formed on a corner between the side face and the bottom face.

15. The liquid discharge head according to claim 13, further comprising a protective film formed on the side face and the bottom face of each of the plurality of common-collection branch channels to protect the side face and the bottom face of each of the plurality of common-collection branch channels from the liquid, wherein the protective film covers the curved portion.

* * * * *